US009519261B2

(12) United States Patent
Leemhuis et al.

(10) Patent No.: US 9,519,261 B2
(45) Date of Patent: Dec. 13, 2016

(54) POSITIONAL CONTROL FEATURES OF A REPLACEABLE UNIT FOR AN ELECTROPHOTOGRAPHIC IMAGE FORMING DEVICE

(71) Applicant: LEXMARK INTERNATIONAL, INC., Lexington, KY (US)

(72) Inventors: Michael Craig Leemhuis, Nicholasville, KY (US); James Daniel Anderson, Jr., Harrodsburg, KY (US); Charles Alan Bast, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/987,942

(22) Filed: Jan. 5, 2016

(65) Prior Publication Data

US 2016/0132019 A1 May 12, 2016

Related U.S. Application Data

(63) Continuation of application No. 14/277,356, filed on May 14, 2014, now Pat. No. 9,261,851, which is a continuation-in-part of application No. 14/084,885, filed on Nov. 20, 2013, now Pat. No. 8,761,639.

(51) Int. Cl.
*G03G 21/16* (2006.01)
*G03G 15/08* (2006.01)

(52) U.S. Cl.
CPC ..... *G03G 21/1652* (2013.01); *G03G 15/0865* (2013.01); *G03G 21/1604* (2013.01); *G03G 21/1647* (2013.01); *G03G 21/1676* (2013.01); *G03G 2215/066* (2013.01); *G03G 2215/0665* (2013.01); *G03G 2215/0668* (2013.01); *G03G 2215/0675* (2013.01); *G03G 2215/0692* (2013.01)

(58) Field of Classification Search
CPC ..... G03G 21/1652; G03G 21/1604; G03G 21/1647; G03G 21/1676; G03G 15/0865; G03G 2215/066; G03G 2215/0665; G03G 2215/0668; G03G 2215/0675; G03G 2215/0692
See application file for complete search history.

(56) References Cited

U.S. PATENT DOCUMENTS 7,536,122 B2 * 5/2009 Ohkawa ..... G03G 15/0856 399/27
2008/0159772 A1 7/2008 Koishi et al.
2014/0169824 A1 6/2014 Seto et al.

* cited by examiner

*Primary Examiner* — Ryan Walsh
(74) *Attorney, Agent, or Firm* — Justin M. Tromp

(57) ABSTRACT

A replaceable unit for an electrophotographic image forming device according to one example embodiment includes an elongated body extending along a lengthwise dimension between a front and a rear of the body. The body has a reservoir for holding toner. The body includes an extension downward from the bottom of the body near the rear of the body. The extension has a downward chute formed therein in fluid communication with the reservoir. A rear face of the extension is unobstructed to receive a bias force in a forward direction toward the front of the body along the lengthwise dimension. An outlet port on the bottom of the extension is in fluid communication with the chute for transferring toner out of the reservoir. The replaceable unit may include a positioning bump on the bottom of the body at a rearmost position on the bottom of the body.

8 Claims, 25 Drawing Sheets

POSITIONAL CONTROL FEATURES OF A REPLACEABLE UNIT FOR AN ELECTROPHOTOGRAPHIC IMAGE FORMING DEVICE

CROSS REFERENCES TO RELATED APPLICATIONS

This patent application is a continuation application of U.S. patent application Ser. No. 14/277,356, filed May 14, 2014, entitled "Positional Control Features of a Replaceable Unit for an Electrophotographic Image Forming Device," which is a continuation-in-part application of U.S. patent application Ser. No. 14/084,885, filed Nov. 20, 2013, entitled "Replaceable Unit for an Electrophotographic Image Forming Device having a Latching Mechanism."

BACKGROUND

1. Field of the Disclosure

The present disclosure relates generally to image forming devices and more particularly to positional control features of a replaceable unit for an electrophotographic image forming device.

2. Description of the Related Art

In order to reduce the premature replacement of components traditionally housed within a toner cartridge for an image forming device, toner cartridge manufacturers have begun to separate components having a longer life from those having a shorter life into separate replaceable units. Relatively longer life components are positioned in one replaceable unit (an imaging unit). The image forming device's toner supply, which is consumed relatively quickly in comparison with the components housed in the imaging unit, is provided in a reservoir in a separate replaceable unit in the form of a toner cartridge that feeds toner to the imaging unit. In this configuration, the number of components housed in the toner cartridge is reduced in comparison with traditional toner cartridges.

It is important that the toner cartridge is precisely aligned within the image forming device. If the toner cartridge is misaligned, the exit port on the toner cartridge may not seal against the port that receives toner from the toner cartridge potentially causing severe toner leakage which may result in mechanical and print quality defects. Further, if the toner cartridge is misaligned, a drive gear on the toner cartridge may not achieve proper gear mesh with a corresponding drive gear in the image forming device potentially resulting in gear cogging. The toner cartridge must also be rigidly held in place after it is installed in the image forming device in order to prevent the positional alignment of the toner cartridge from being disturbed during operation. The requirement for tight positional control must be balanced with the need to permit a user to easily load and unload the toner cartridge into and out of the image forming device. Accordingly, it will be appreciated that precise alignment of the cartridge and relatively simple insertion and removal of the cartridge into and out of the image forming device is desired.

SUMMARY

A replaceable unit for an electrophotographic image forming device according to one example embodiment includes an elongated body extending along a lengthwise dimension between a front and a rear of the body. The body further includes a first side, a second side, a top and a bottom. The body has a reservoir for holding toner. A drive element on the rear of the body is unobstructed to receive rotational power when the replaceable unit is installed in the image forming device. An electrical contact on the rear of the body is unobstructed to contact a corresponding electrical contact when the replaceable unit is installed in the image forming device. The body includes an extension downward from the bottom of the body near the rear of the body. The extension has a downward chute formed therein in fluid communication with the reservoir. A rear face of the extension is unobstructed to receive a bias force in a forward direction toward the front of the body along the lengthwise dimension. An outlet port on the bottom of the extension is in fluid communication with the chute for transferring toner out of the reservoir. A latch catch on the first side of the body is positioned to receive a corresponding latch when the replaceable unit is installed in the image forming device to restrain the body from moving in the forward direction along the lengthwise dimension.

A replaceable unit for an electrophotographic image forming device according to another example embodiment includes an elongated body extending along a lengthwise dimension between a front and a rear of the body. The body further includes a first side, a second side, a top and a bottom. The body has a reservoir for holding toner. An outlet port is positioned on the bottom of the body near the rear of the body for transferring toner out of the reservoir. A positioning bump is positioned on the bottom of the body at a rearmost position on the bottom of the body. The outlet port is spaced farther from the rear of the body than the positioning bump and toward one of the first side and the second side from the positioning bump.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes; etc.; may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
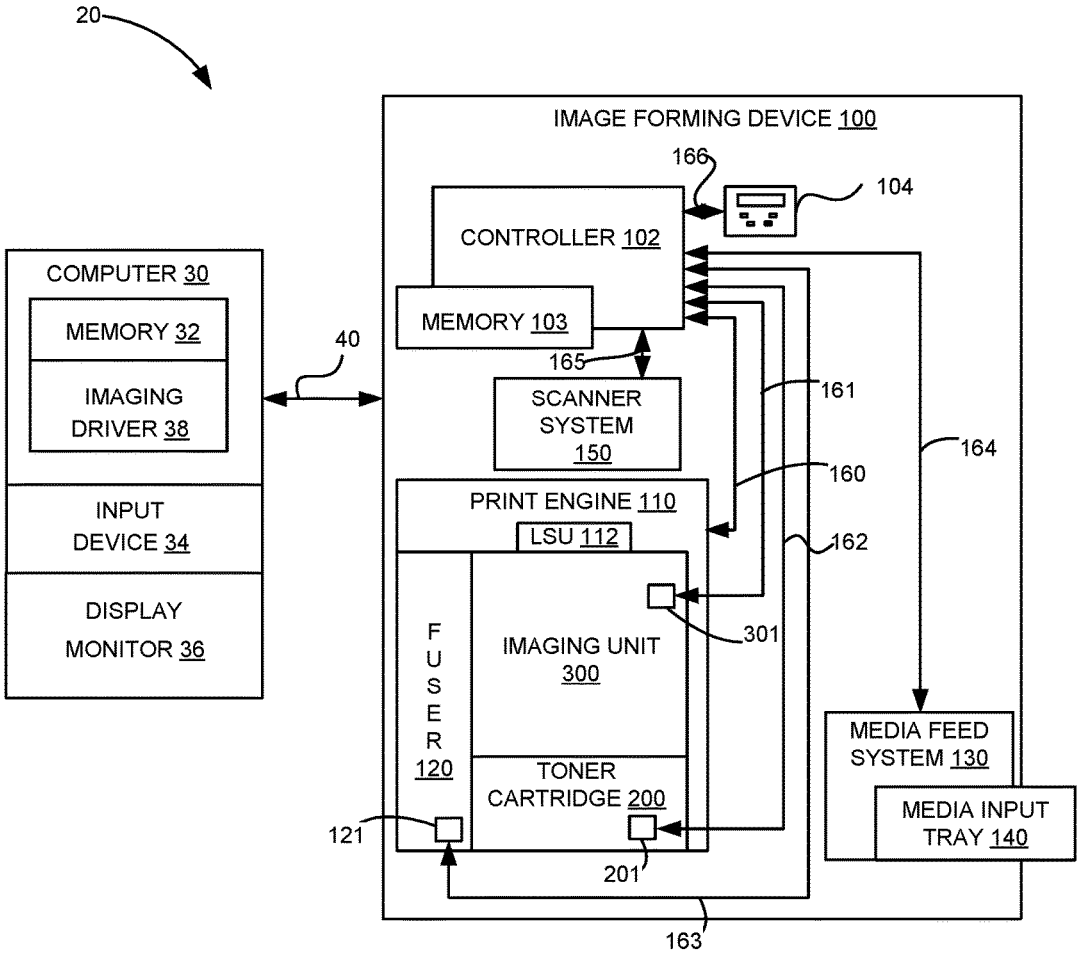
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AK)) device) that includes a controller 102, a print engine 110, a laser scan unit (LSU) 112, one or more toner bottles or cartridges 200, one or more imaging units 300, a insert 120, a user interface 104, a media feed system 130 and media input tray 140 and a scanner system 150 image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103 and may be formed as one or more Application Specific integrated Circuits (ASICs). Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined punter and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory such as RAM, ROM, and/or NVRAM and may provide authentication functions, safety and operational interlocks, operating parameters and usage information related to fuser 120, toner cartridge(s) 200 and imaging units 300, respectively. Controller 102 processes print and scan data and operates print engine 110 during printing and scanner system 150 during scanning.

Computer 30, which is optional, may be, for example, a personal computer, including memory 32, such as RAM. ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
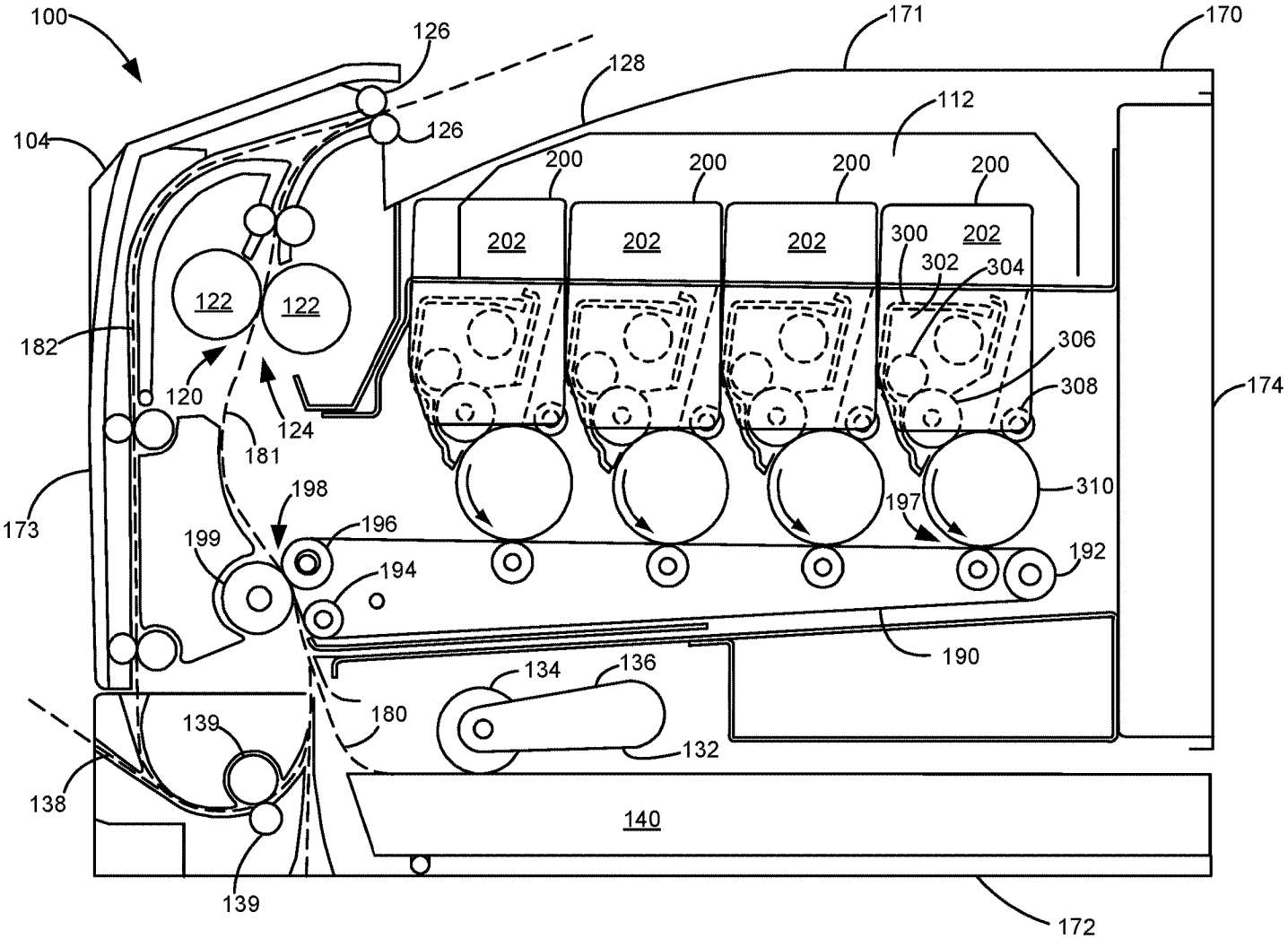
FIG. 2 is a schematic diagram of an image forming device according to a first example embodiment.

FIG. 2 illustrates a schematic view of the interior of an example image forming device 100. For purposes of clarity, the components of only one of the imaging units 300 are labeled in FIG. 2. Image forming device 100 includes a housing 170 having a top 171, bottom 172, front 173 and rear 174. Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable for refilling. User interface 104 is shown positioned on housing 170. Using user interface 104, a user is able to enter commands and generally control the operation of the image forming device 100. For example, the user may enter commands to switch modes (e.g., color mode, monochrome mode), view the number of pages printed, etc. A media path 180 extends through image forming device 100 for moving the media sheets through the image transfer process. Media path 180 includes a simplex path 181 and may include a duplex path 182. A media sheet is introduced into simplex path 181 from tray 140 by a pick mechanism 132. In the example embodiment shown, pick mechanism 132 includes a roll 134 positioned at the end of a pivotable arm 136. Roll 134 rotates to move the media sheet from tray 140 and into media path 180. The media sheet is then moved along media path 180 by various transport rollers. Media sheets may also be introduced into media path 180 by a manual feed 138 having one or more rolls 139.

In the example embodiment shown, image forming device 100 includes four toner cartridges 200 removably mounted in housing 170 in a mating relationship with four corresponding imaging units 300 also removably mounted in housing 170. Each toner cartridge 200 includes a reservoir 202 for holding toner and an outlet port in communication with an inlet port of its corresponding imaging unit 300 for transferring toner from reservoir 202 to imaging unit 300. Toner is transferred periodically from a respective toner cartridge 200 to its corresponding imaging unit 300 in order to replenish the imaging unit 300. In the example embodiment illustrated, each toner cartridge 200 is substantially the same except for the color of toner contained therein. In one embodiment, the four toner cartridges 200 include yellow, cyan, magenta and black toner. Each imaging unit 300 includes a toner reservoir 302 and a toner adder roll 304 that moves toner from reservoir 302 to a developer roll 306. Each imaging unit 300 also includes a charging roll 308 and a photoconductive (PC) drum 310. PC drums 310 are mounted substantially parallel to each other when the imaging units 300 are installed in image forming device 100. In the example embodiment illustrated, each imaging unit 30( )is substantially the same except for the color of toner contained therein.

Each charging roll 308 forms a nip with the corresponding PC drum 310. During a print operation, charging roll 308 charges the surface of PC drum 310 to a specified voltage such as, for example, −1000 volts. A laser beam from LSU 112 is then directed to the surface of PC drum 310 and selectively discharges those areas it contacts to form a latent image. In one embodiment, areas on PC drum 310 illuminated by the laser beam are discharged to approximately −300 volts. Developer roll 306, which forms a nip with the corresponding PC drum 310, then transfers toner to PC drum 310 to form a toner image on PC drum 310. A metering device such as a doctor blade assembly can be used to meter toner onto developer roll 306 and apply a desired charge on the toner prior to its transfer to PC drum 310. The toner is attracted to the areas of the surface of PC drum 310 discharged by the laser beam from LSU 112.

An intermediate transfer mechanism (ITM) 190 is disposed adjacent to the PC drums 310. In this embodiment, ITM 190 is formed as an endless belt trained about a drive roll 192, a tension roll 194 and a back-up roll 196. During image forming operations, ITM 190 moves past PC drums 310 in a clockwise direction as viewed in FIG. 2. One or more of PC drums 310 apply toner images in their respective colors to ITM 190 at a first transfer nip 197. In one embodiment, a positive voltage field attracts the toner image from PC drums 310 to the surface of the moving ITM 190. ITM 190 rotates and collects the one or more toner images from PC drums 310 and then conveys the toner images to a media sheet at a second transfer nip 198 formed between a transfer roll 199 and ITM 190, which is supported by back-up roll 196.

A media sheet advancing through simplex path 181 receives the toner image from ITM 190 as it moves through the second transfer nip 198. The media sheet with the toner image is then moved along the media path 180 and into fuser 120. Fuser 120 includes fusing rolls or belts 122 that form a nip 124 to adhere the toner image to the media sheet. The fused media sheet then passes through exit rolls 126 located downstream from fuser 120. Exit rolls 126 may be rotated in either forward or reverse directions. In a forward direction, exit rolls 126 move the media sheet from simplex path 181 to an output area 128 on top 171 of image forming device 100. In a reverse direction, exit rolls 126 move the media sheet into duplex path 182 for image formation on a second side of the media sheet.

Figure 3:
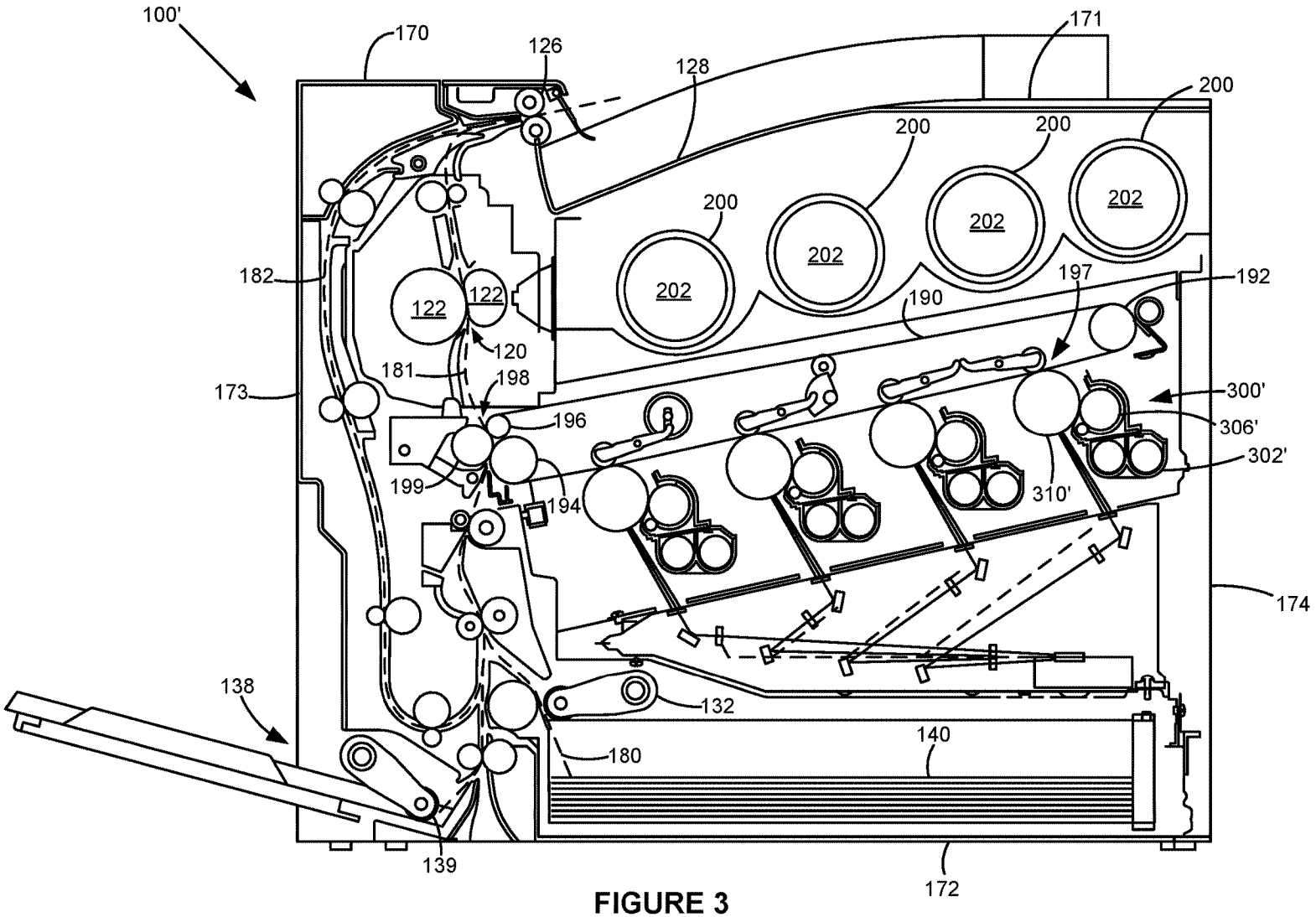
FIG. 3 is a schematic diagram of an image forming device according to a second example embodiment.

FIG. 3 illustrates an example embodiment of an image forming device 100' that utilizes what is commonly referred to as a dual component developer system. In this embodiment, image forming device 100' includes four toner cartridges 200 removably mounted in housing 170 and mated with four corresponding imaging units 300'. Toner is periodically transferred from reservoirs 202 of each toner cartridge 200 to corresponding reservoirs 302' of imaging units 300'. The toner in reservoirs 302' is mixed with magnetic carrier beads. The magnetic carrier beads may be coated with a polymeric film to provide triboelectric properties to attract toner to the carrier beads as the toner and the magnetic carrier beads are mixed in reservoir 302'. In this embodiment, each imaging unit 300' includes a magnetic roll 306' that attracts the magnetic carrier beads having toner thereon to magnetic roll 306' through the use of magnetic fields and transports the toner to the corresponding photoconductive drum 310'. Electrostatic forces from the latent image on the photoconductive drum 310' strip the toner from the magnetic carrier beads to provide a toned image on the surface of the photoconductive drum 310'. The toned image is then transferred to ITM 190 at first transfer nip 197 as discussed above.

While the example image forming devices 100 and 100' shown in FIGS. 2 and 3 illustrate four toner cartridges 200 and four corresponding imaging units 300, 300', it will be appreciated that a monocolor image forming device 100 or 100' may include a single toner cartridge 200 and corresponding imaging unit 300 or 300' as compared to a color image forming device 100 or 100' that may include multiple toner cartridges 200 and imaging units 300, 300'. Further, although imaging forming devices 100 and 100' utilize ITM 190 to transfer toner to the media, toner may be applied directly to the media by the one or more photoconductive drums 310, 310' as is known in the art. In addition, toner may be transferred directly from each toner cartridge 200 to its corresponding imaging unit 300 or 300' or the toner may pass through an intermediate component such as a chute, duct or hopper that connects the toner cartridge 200 with its corresponding imaging unit 300 or 300'.

Figure 4:
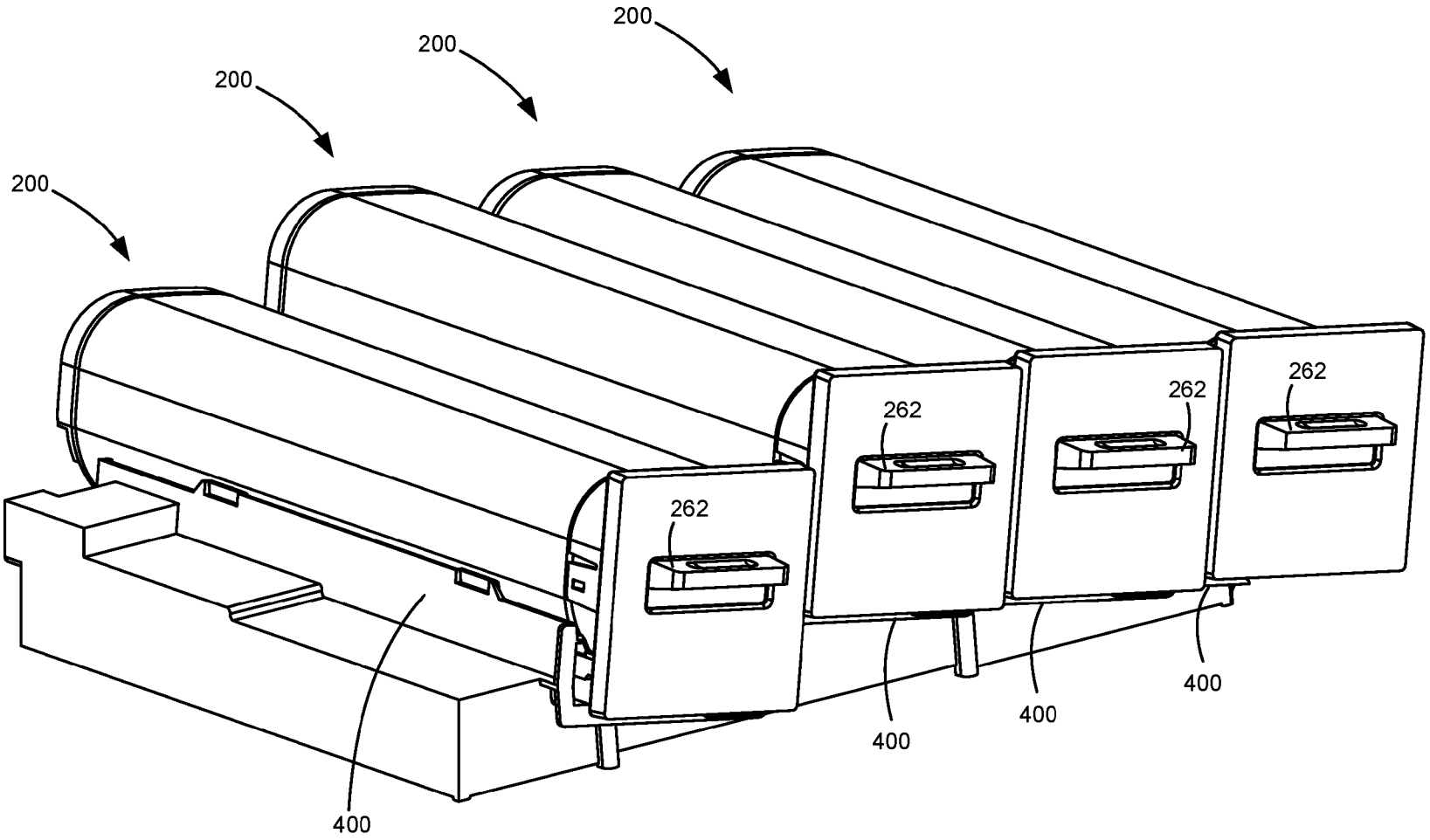
FIG. 4 is a perspective view of four toner cartridges positioned in four corresponding trays according to one example embodiment.

With reference to FIG. 4, four toner cartridges 200 are shown positioned in four corresponding trays 40( )in image forming device 100, 100' according to one example embodiment. In the example embodiment shown, trays 400 are formed from a unitary element; however, trays 400 may be formed from separate elements mounted together as desired. Trays 400 are mounted in a stationary position within housing 170 of image forming device 100, 100'. In the example embodiment shown, the vertical positions of trays 400 and toner cartridges 200 vary; however, the positioning of the toner cartridges 200 relative to each other is a matter of design choice. Each toner cartridge 200 is independently insertable into and removable from its corresponding tray 400 in order to permit a user to individually remove and replace each toner cartridge 200 when it runs out of usable toner.

Figure 5:
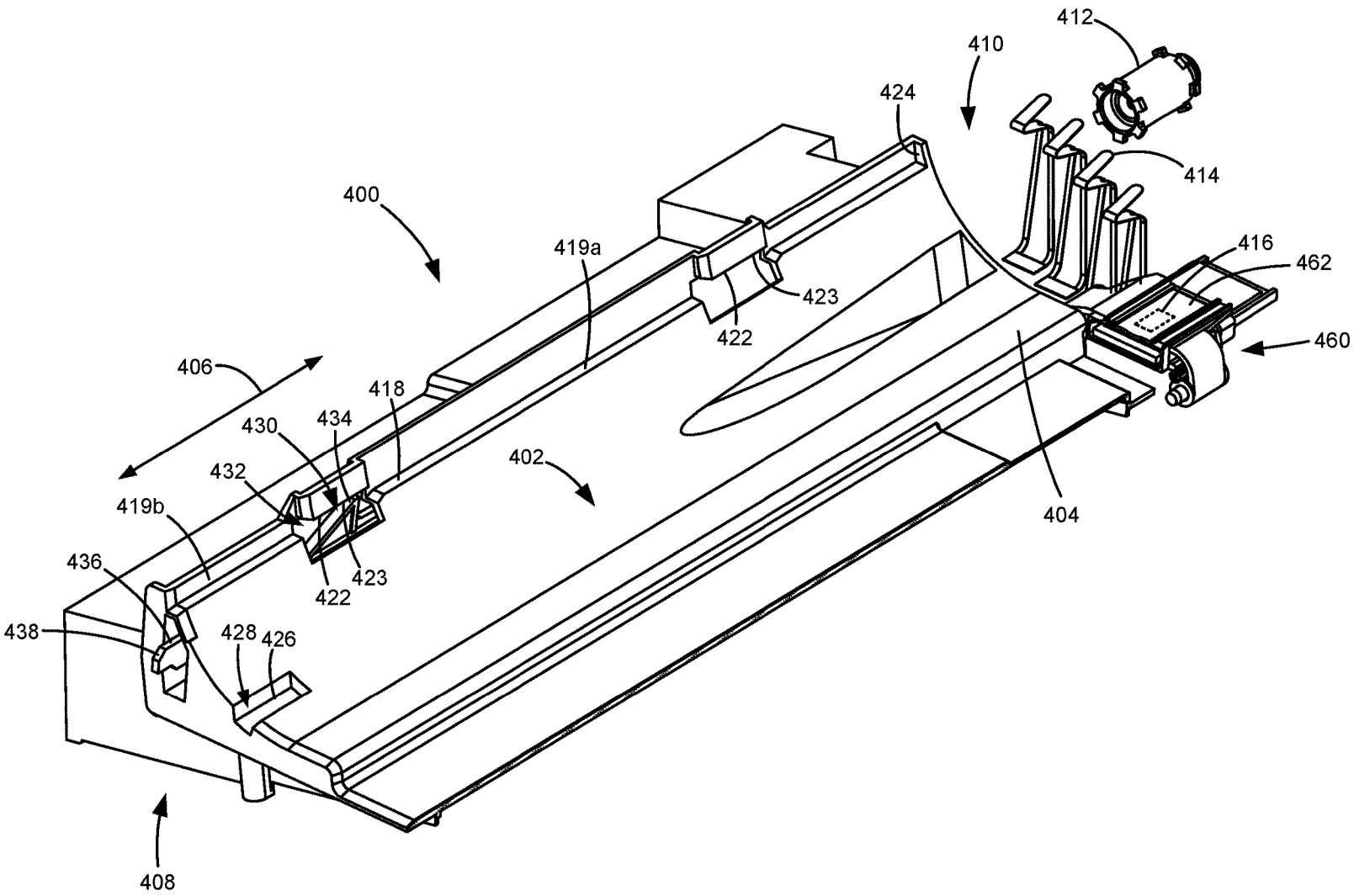
FIG. 5 is a perspective view of one of the trays shown in FIG. 4 with the corresponding toner cartridge removed.

FIG. 5 shows a portion of one of the trays 400 with the corresponding toner cartridge 200 removed. Tray 400 includes a cartridge storage area 402 that is sized and shaped to hold the corresponding toner cartridge 200. Cartridge storage area 402 is defined by a top surface 404 that generally conforms to the shape of the exterior of the lower portion of toner cartridge 200 including the bottom and sides of toner cartridge 200. Cartridge storage area 402 extends along a lengthwise dimension 406 and is open at a front end 408 to permit the insertion and removal of the corresponding cartridge 200 into and out of cartridge storage area 402. Front end 408 is accessible to a user upon opening one or more access doors or panels on housing 170 of image forming device 100, 100'. A rear end 410 of cartridge storage area 402 includes a drive element 412, such as a gear or other form of drive coupler, positioned to engage a corresponding drive element on toner cartridge 200 in order to provide rotational power to rotating components of toner cartridge 200 such as toner agitators in reservoir 202. Rear end 410 also includes one or more electrical contacts 414 that mate with corresponding electrical contacts of toner cartridge 200 in order to facilitate communications link 162 between processing circuitry 201 on toner cartridge 200 and controller 102 of image forming device 100, 100'.

Figure 6B:
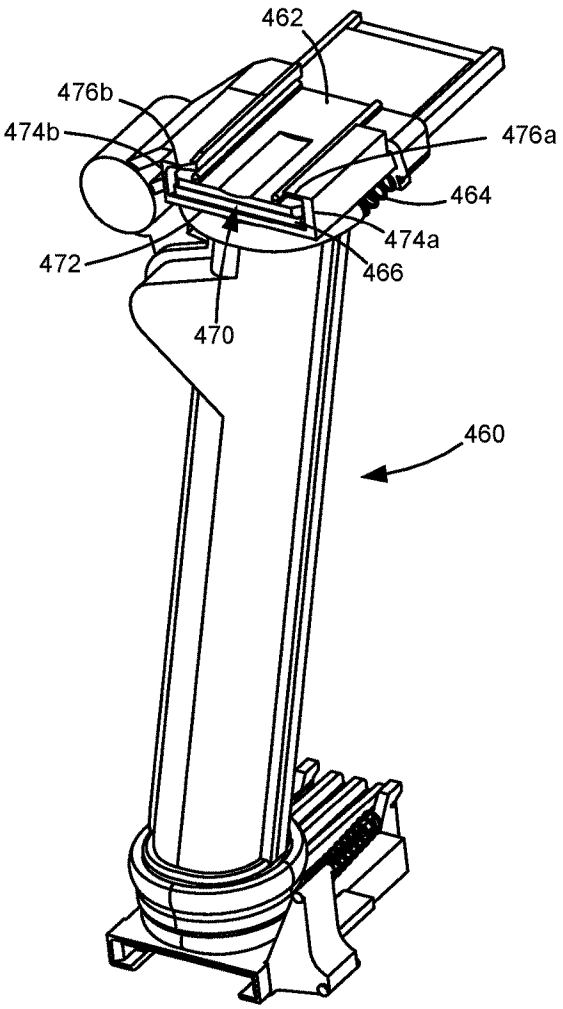
FIG. 6B is a perspective view of the toner chute shown in FIG. 6A showing the shutter in a closed position blocking the inlet port.
Figure 6A:
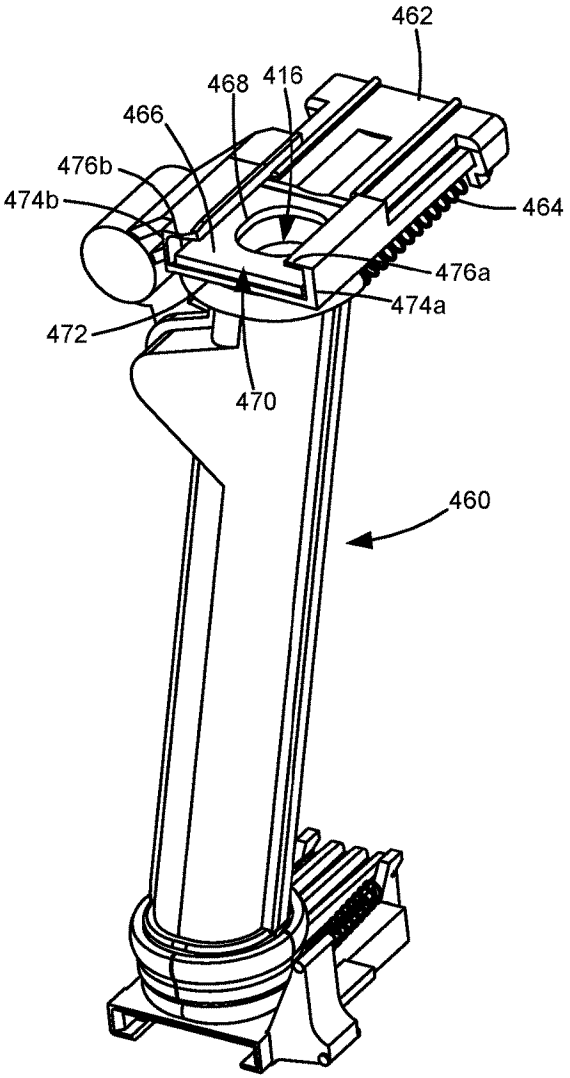
FIG. 6A is a perspective view of a toner chute having a shutter in an open position unblocking an inlet port for receiving toner from a corresponding toner cartridge according to one example embodiment.

A toner inlet port 416 is positioned near rear end 410 of cartridge storage area 402. Inlet port 416 is positioned to receive toner from a corresponding outlet port of toner cartridge 200. Inlet port 416 may be a component of imaging unit 300, 300' or an intermediate component such as a chute, duct or hopper that permits toner flow from toner cartridge 200 to its corresponding imaging unit 300, 300'. FIGS. 6A and 6B show inlet port 416 according to one example embodiment. In this embodiment, toner inlet port 416 is formed in a toner chute 460 having a duct therethrough that provides a path for toner exiting an outlet port of toner cartridge 200 to the toner reservoir 302, 302' of its corresponding imaging unit 300, 300'. A shutter 462 is positioned on toner chute 460 above inlet port 416 and is slidably movable between an open position shown in FIG. 6A and a closed position shown in FIG. 6B. In the open position, shutter 462 permits toner to flow into inlet port 416. In the closed position, shutter 462 blocks inlet port 416 to prevent toner from leaking out of inlet port 416 when toner cartridge 200 is absent from tray 400. Shutter 462 is biased toward the closed position blocking inlet port 416 such as, for example, by one or more extension springs 464. In the example embodiment illustrated, shutter 462 slides toward front end 408 when shutter 462 moves from the open position to the closed position and away from front end 408 when shutter 462 moves from the closed position to the open position. A seal 466 may be positioned on a top portion of toner chute 460 near inlet port 416 to capture any toner leaked between the outlet port of toner cartridge 200 and inlet port 416 and to provide a sealing force between toner cartridge 200 and toner chute 460. In the embodiment illustrated, seal 466 surrounds inlet port 416 and includes an opening 468 aligned with inlet port 416 to allow toner to enter inlet port 416. Seal 466 may be composed of foam material such as PORON® from Rogers Corporation, Rogers, Conn., USA.

In the example embodiment illustrated, toner chute 460 includes a forward facing generally C-shaped channel 470 on the top portion of toner chute 460 that retains shutter 462 and guides the sliding motion of shutter 462. Channel 470 also aids in positioning toner cartridge 200 when toner cartridge 200 is installed in tray 400 as discussed in greater detail below. Channel 470 is formed by a top surface 472 of toner chute 460, opposed generally vertical walls 474*a* and 474*b* and ledges 476*a* and 476*b* that extend in a generally horizontal direction from walls 474*a* and 474*b*, respectively. Walls 474*a* and 474*b* extend upward from top surface 472 of toner chute 460 on opposite sides of toner chute 460. Ledges 476*a* and 476*b* extend inward toward each other from top portions of walls 474*a* and 474*b*. In particular, ledge 476*a* extends from a top portion of wall 474*a* toward wall 474*b* and ledge 476*b* extends from a top portion of wall 474*b* toward wall 474*a*. In one embodiment, top surface 472, walls 474*a* and 474*b* and/or ledges 476*a* and 476*b* have tapered surfaces leading into channel 470 to facilitate the entry of toner cartridge 200.

With reference back to FIG. 5, tray 400 includes additional alignment features that position toner cartridge 200 relative to drive element 412, electrical contacts 414 and inlet port 416. Tray 400 includes a pair of loading rails 418, 420 (FIG. 12) running along lengthwise dimension 406 of cartridge storage area 402 between front end 408 and rear end 410. Loading rails 418, 420 are positioned at opposite sides of cartridge storage area 402 to engage opposite sides of the toner cartridge 200 installed therein. Each loading rail 418, 420 includes a top rail surface 419*a*, 421*a* (FIG. 12) on which a positioning rib of toner cartridge 200 may rest. Each loading rail 418, 420 also includes an outer side restraint 419*b*, 421*b* (FIG. 12) that limits the side-to-side motion of toner cartridge 200 in cartridge storage area 402. One or more hold-down features 422 are spaced above each loading rail 418, 420 example, in the embodiment illustrated, each loading rail 418, 420 includes a pair of hold-down features 422, a first hold-down feature 422 proximate to front end 408 and a second hold-down feature 422 proximate to rear end 410. Each hold-down feature 422 includes a bottom contact surface 423 positioned to serve as an upper restraint to prevent toner cartridge 200 from rising out of cartridge storage area 402. Each loading rail 418, 42.0 is open at front end 408 in order to permit toner cartridge 200 to be inserted and removed at front end 408. A stop 424 is positioned at rear end 410 of each loading rail 418, 420 to prevent over-insertion of toner cartridge 200 into tray 400. In the example embodiment illustrated, each stop 424 includes a generally vertical wall extending upward at rear ends 410 of loading rails 418, 420.

Tray 400 may also include a keying structure 426 that prevents the wrong toner cartridge 200 from being inserted into tray 400. For example, where each toner cartridge 200 provides a different color toner, such as where toner cartridges 200 having black, cyan, yellow and magenta toners are used, keying structure 426 prevents each toner cartridge 200 from being inserted into the tray 400 corresponding with any other color. For example, keying structure 426 may prevent a toner cartridge 200 containing black, yellow or magenta colored toner from being positioned in the tray 400 for a cyan toner cartridge 200. In the example embodiment illustrated, keying structure 426 includes an indentation or slot 428 along lengthwise dimension 406 in top surface 404 at front end 408 of tray 400 positioned to receive a corresponding keying structure on toner cartridge 200. The location of slot 428 varies for each tray 400 in order to prevent a toner cartridge 200 from being inserted into a tray 400 unless its keying structure matches the keying structure 426 of the tray 400.

Tray 400 also includes a latch 430 that retains toner cartridge 200 in its final operating position in tray 400 as discussed in greater detail below. Latch 430 is positioned in a channel 432 that runs along lengthwise dimension 406 from front end 408 toward rear end 410 beneath loading rail 418. Latch 430 includes an engagement feature such as a fin 434 that is spaced inward from front end 408 and projects upward through top rail surface 419*a* in position to contact toner cartridge 200 when toner cartridge 200 is installed in tray 400. Latch 430 also includes an engagement feature such as an arm 436 at a distal end 438 of latch 430 that is exposed at front end 408 of tray 400.

Figure 7:
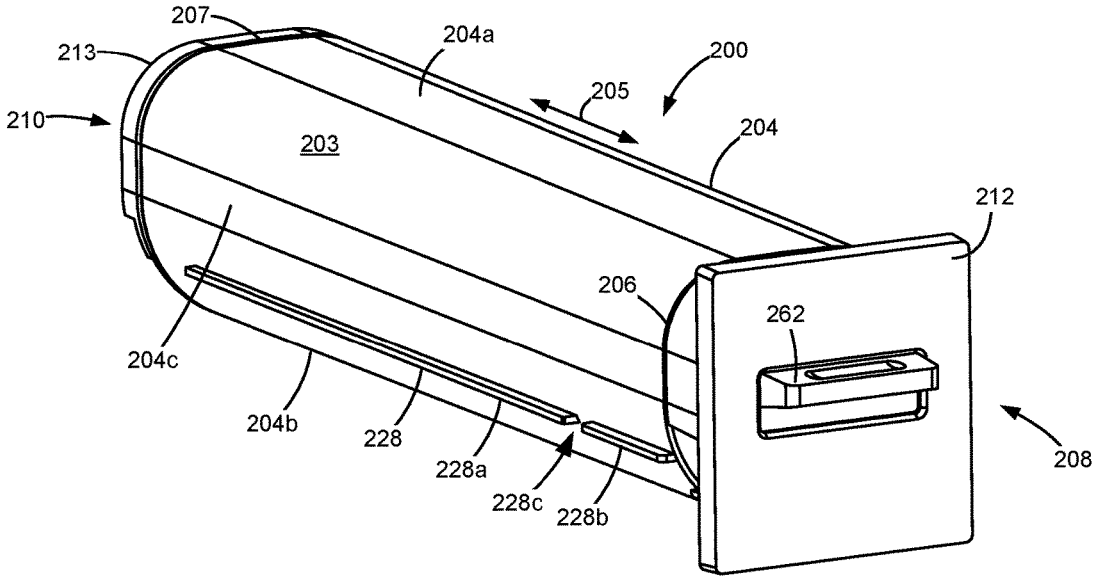
FIG. 7 is front perspective view of one of the toner cartridges shown in FIG. 4.
Figure 8:
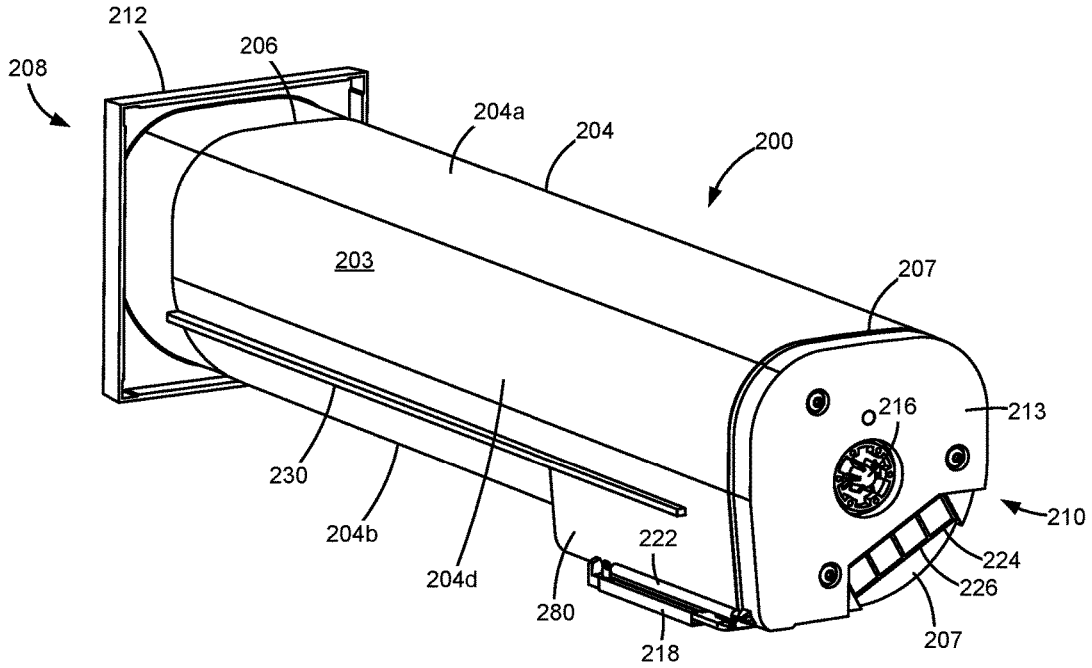
FIG. 8 is a rear perspective view of the toner cartridge shown in FIG. 7.
Figure 9:
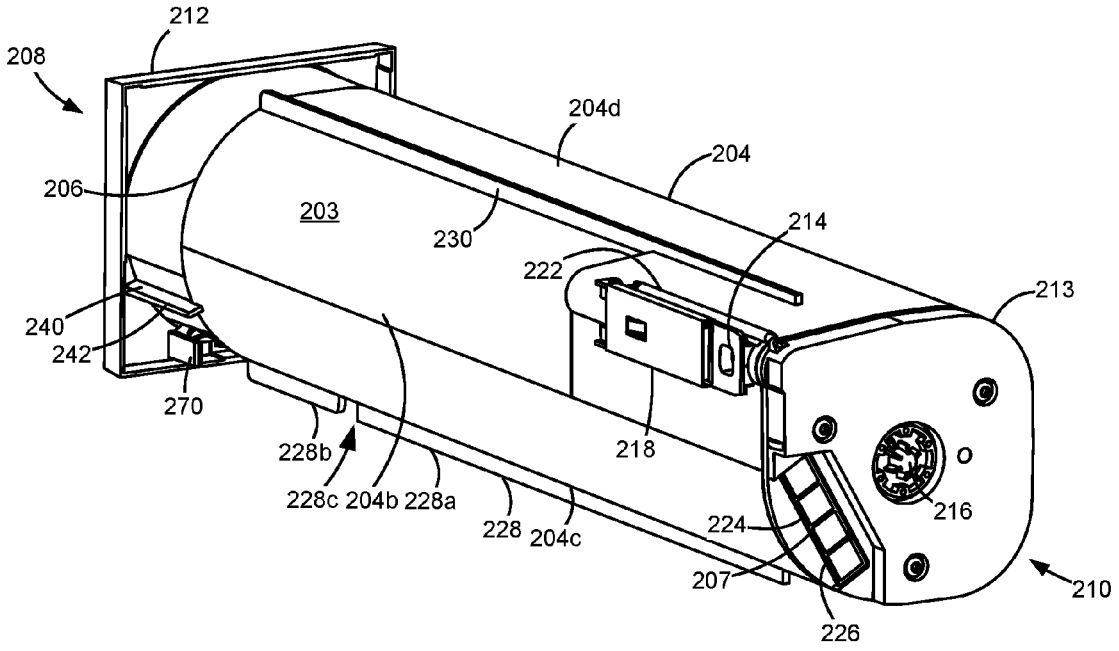
FIG. 9 is a bottom perspective view of the toner cartridge shown in FIGS. 7 and 8.

FIGS. 7-9 show toner cartridge 200 according to one example embodiment. Toner cartridge 200 includes an elongated body 203 that includes walls forming toner reservoir 202. (FIGS. 2 and 3). In the example embodiment illustrated, body 203 includes a generally cylindrical wall 204 that extends along a lengthwise dimension 205 and a pair of end walls 206, 207 defining a front end 208 and a rear end 210, respectively, of toner cartridge 200. Wall 204 includes a top 204*a*, bottom 204*b* and sides 204*c*, 204*d*. In the embodiment illustrated, end caps 212, 213 are mounted on end walls 206, 207, respectively, such as by suitable fasteners (e.g., screws, rivets, etc.) or by a snap-fit engagement. An outlet port 214 is positioned on bottom 204*b* of body 203 near end wall 207. Toner is periodically delivered from reservoir 202 through outlet port 214 to inlet port 416 to refill reservoir 302 302' of imaging unit 300, 300' as toner is consumed by the printing process.

Toner cartridge 200 includes one or more agitators e.g., paddles, augers, etc.) to stir and move toner within reservoir 202 toward outlet port 214. In the example embodiment illustrated, a drive element 216, such as a gear or other form of drive coupler, is positioned on an outer surface of end wall 207. Drive element 216 is positioned to engage corresponding drive element 412 when toner cartridge 200 is installed in tray 400 in order to receive rotational power to drive the agitator(s) in reservoir 202. The agitator(s) within reservoir 202 may be connected directly or by one or more intermediate gears to drive element 216.

With reference to FIGS. 8 and 9, in one embodiment, body 203 includes a toner exit section 280 formed on bottom 204*b* of wall 204 near side 204*d* and end wall 207. Outlet port 214 is positioned on the bottom of toner exit section 280 near end wall 207. Toner exit section 280 includes a channel (not shown) that forms a path for toner to exit reservoir 202 through outlet port 214. In one embodiment, a rotatable auger (not shown) is positioned in the channel of toner exit section 280 to move toner to outlet port 214. In the example embodiment illustrated, toner exit section 280 does not extend the entire length of toner bottle 200; instead, toner exit section 280 extends less than one third of the way from end wall 207 to end wall 206. For example, as shown in FIGS. 8 and 9, toner exit section 280 extends further outward from the intersection between bottom 204*b* and side 204*d* near end wall 207 in comparison with the transition from side 204*d* to bottom 204*b* proximate end wall 206.

Figure 10A:
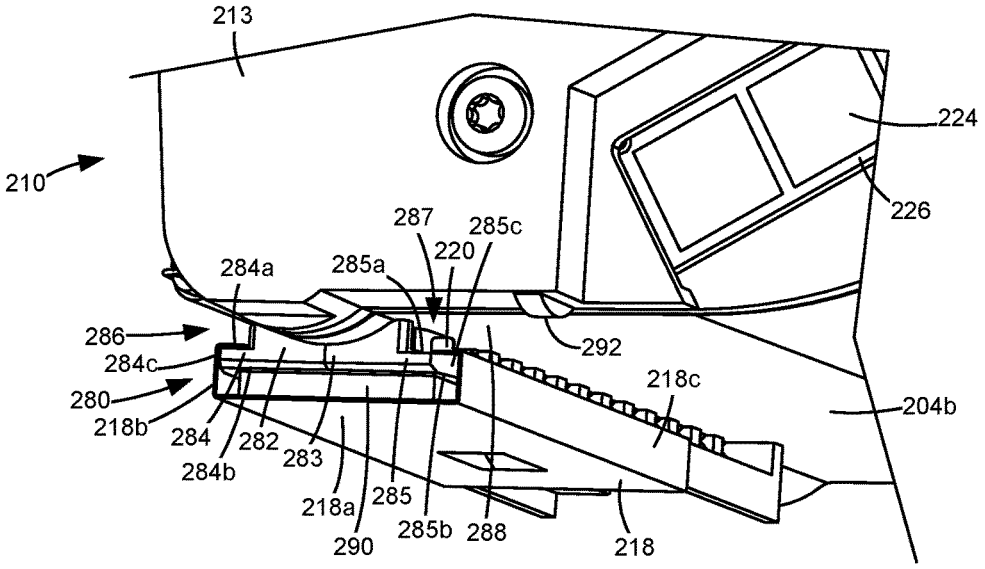
FIG. 10A is a rear perspective view of the toner cartridge shown in FIG. 7 showing a shutter in a closed position blocking an outlet port of the toner cartridge according to one example embodiment.
Figure 10B:
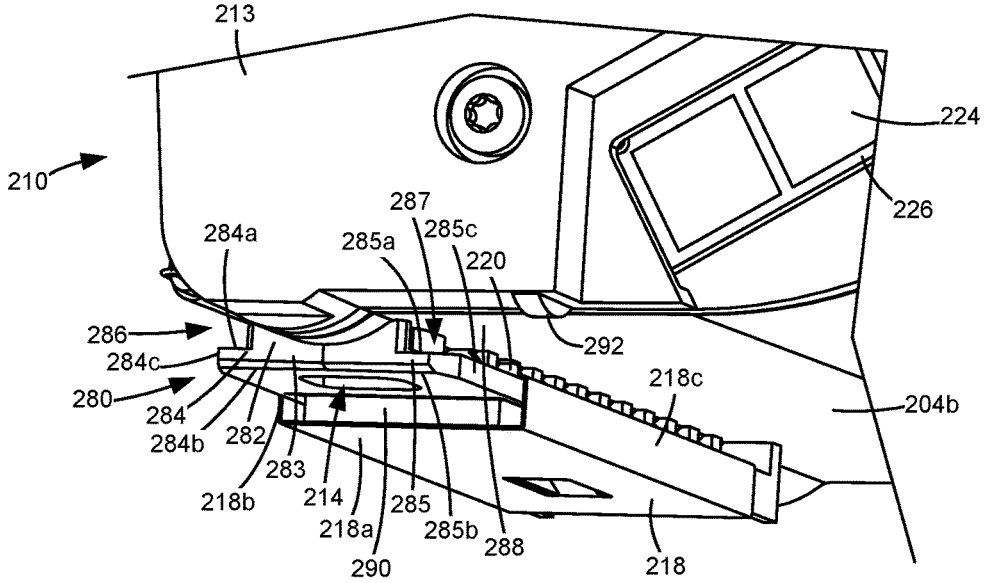
FIG. 10B is a first rear perspective view of the toner cartridge shown in FIG. 7 showing the shutter in an open position unblocking the outlet port of the toner cartridge.
Figure 11:
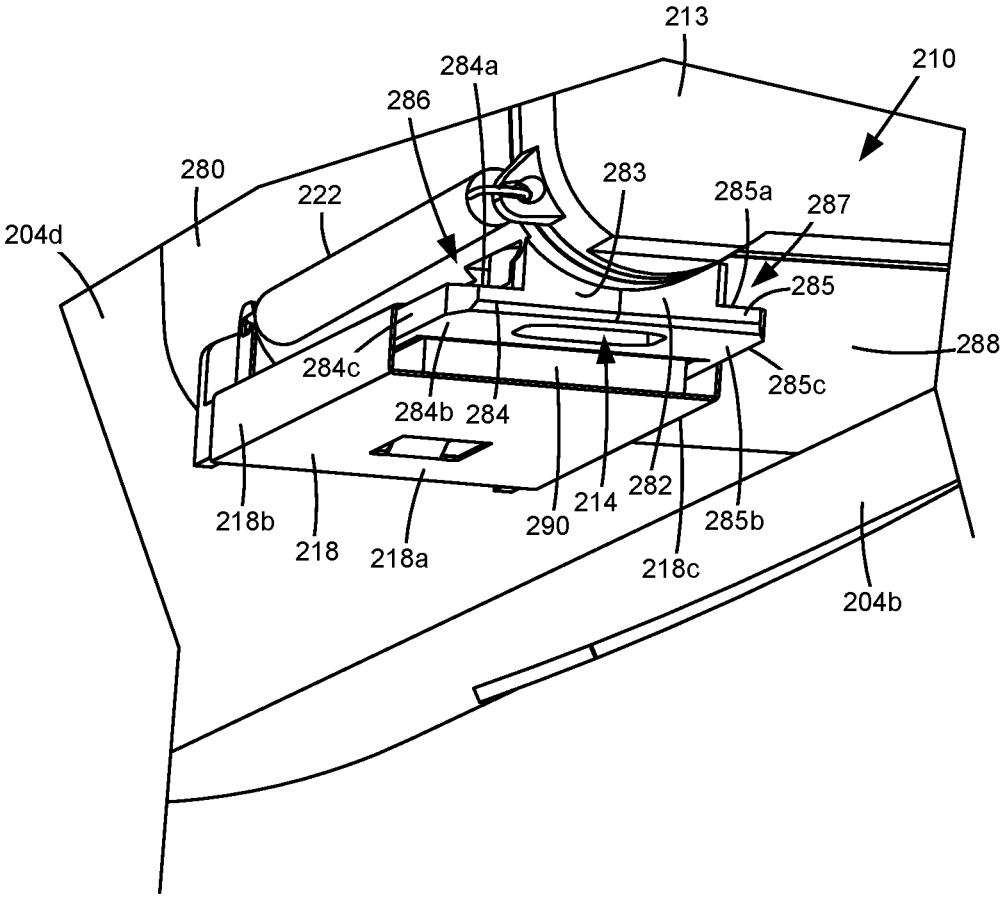
FIG. 11 is a second rear perspective view of the toner cartridge shown in FIG. 7 showing the shutter in an open position unblocking the outlet port of the toner cartridge.

FIGS. 10A, 10B and 11 show the area of toner cartridge 200 near outlet port 214 in greater detail according to one example embodiment. In one embodiment, an inverted shaped extension 282 is formed at the bottom of a portion of toner exit section 280 near end wall 207. As discussed in greater detail below, extension 282 is received by channel 470 of toner chute 460 when toner cartridge 200 is inserted into tray 400. The engagement between extension 282 and channel 470 aligns outlet port 214 vertically with inlet port 416. A chute 283 for toner to drop from the channel in toner exit section 280 to outlet port 214 extends downward from toner exit section 280 and forms the base of the inverted T-shaped extension 282. A pair of ledges 284, 285 extend away from each other toward opposite sides of body 203 and form the rest of the inverted T-shaped extension 282. Ledges 284, 285 run in lengthwise dimension 205 along the length of extension 282. A pocket 286, 287 is formed above each ledge 284, 285 between a top surface 284*a*, 285*a* of the ledge 284, 285 and a bottom surface 288 of toner exit section 280. Ledges 284, 285 also have bottom surfaces 284*b*, 285*b* and outer side surfaces 284*c*, 285*c*. Each ledge 284, 285 may have a tapered lead-in surface at its rear end to facilitate entry of extension 282 into channel 470 as discussed in greater detail below.

In one embodiment, a shutter 218 is positioned on bottom 204*b* of body 203 and is slidably movable between a closed position shown in FIG. 10A and an open position shown in FIG. 10B. In the open position, shutter 218 permits toner to flow from outlet port 214 of toner cartridge 200. In the closed position, shutter 218 blocks outlet port 214 to prevent toner from escaping toner cartridge 200, the embodiment illustrated, shutter 218 is positioned on extension 282. In this embodiment, shutter 218 includes a base 218*a* that forms the blocking portion of shutter 218 and flanges 218*b*, 218*c* that extend upward from base 218*a* on opposite sides of base 218*a*. Each flange 218*b*, 218*c* wraps over the top of a respective ledge 284, 285 to retain shutter 218 on extension 282. When shutter 218 slides between the open and closed positions, flanges 218*b*, 218*c* slide across top surfaces 284*a*, 285*a* and outer side surfaces 284*c*, 285*c* of ledges 284, 285. Shutter 218 may be biased toward the closed position blocking outlet port 214. For example, one or more extension springs 222 may bias shutter 218 toward the closed position as shown. In the example embodiment illustrated, shutter 218 slides toward front end 208 when shutter 218 moves from the closed position to the open position and toward rear end 210 when shutter 218 moves from the open position to the closed position.

Shutter 18 includes an actuation tab 220 extending from shutter 218 in a direction generally orthogonal to lengthwise dimension 205. Actuation tab 220 is positioned to receive a force from a portion of toner chute 460 such as one of the walls 474 or ledges 476 forming channel 470 during insertion of toner cartridge 200 into tray 400. In the example embodiment illustrated, tab 220 extends from flange 218*c* that is positioned proximate an inner portion of body 203 in the side-to-side direction and away from side 204*d*. In this example, tab 220 extends upward from flange 218*c* into pocket 287. In this position, tab 220 is protected by ledge 285 and bottom surface 288 of toner exit section 280 from accidental actuation by a user when toner cartridge 200 is not installed in the image forming device which could result in toner escaping from outlet port 214. In another embodiment, tab 220 extends sideways from flange 218*c* away from side 204*d* and toward side 204*c*, other embodiments, tab 220 extends upward or sideways from flange 218*b* or downward from base 218*a*.

Shutter 218 may also include a seal 290 sandwiched between shutter 218 and extension 282 to capture any toner leaked from outlet port 214. In one embodiment, seal 290 is fixed to shutter 218 and slides with shutter 218 against extension 282. In another embodiment, seal 290 is fixedly positioned on a bottom surface of extension 282 surrounding outlet port 214. In this embodiment, seal 290 includes an opening aligned with outlet port 214 to allow toner to exit outlet port 214 and seal 290 provides a sealing force between toner cartridge 200 and toner chute 460. As discussed above with respect to seal 466, seal 290 may be composed of a foam material such as PORON® from Rogers Corporation, Rogers, Conn., USA.

Toner cartridge 200 may also include a positioning projection or bump 292 at rear end 210 of toner cartridge 200 on the bottom of toner cartridge 200. In the embodiment illustrated, positioning bump 292 is positioned on a bottom surface of end cap 213. Positioning bump 292 is spaced in the side-to-side direction toward the center of body 203 (i.e., toward side 204*c*) from outlet port 214. Positioning bump 292 is also positioned closer to rear end 210 than the rearmost portion of extension 282. Positioning bump 292 aids in positioning toner cartridge 200 vertically during insertion of toner cartridge 200 into tray 400 to ensure that channel 470 of toner chute 460 receives extension 282 of toner cartridge 200 so that outlet port 214 mates with inlet port 416 to transfer toner from reservoir 202 to toner chute 460. In one embodiment, positioning bump 292 includes a tapered lead-in and lead-out in lengthwise dimension 205 to facilitate the engagement and disengagement between positioning bump 292 and top surface 404 of tray 400 as discussed in greater detail below.

Figure 12:
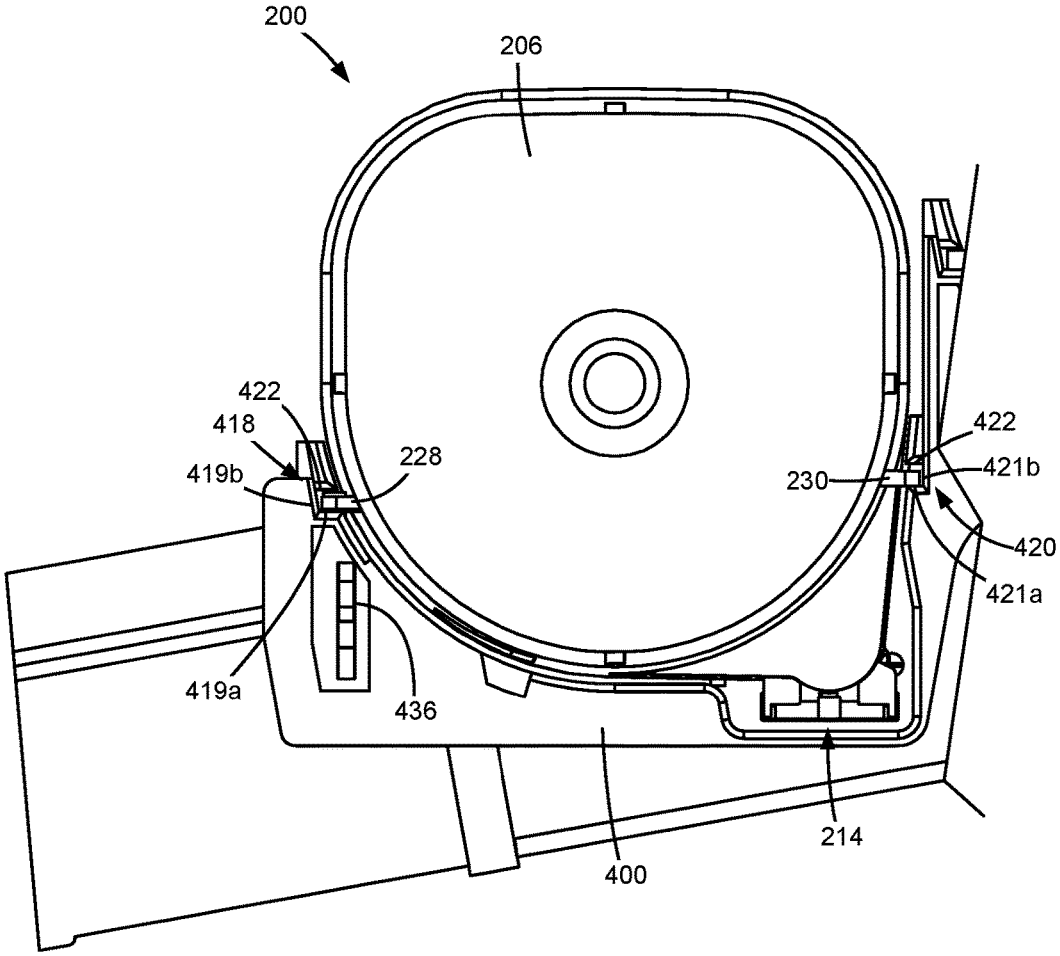
FIG. 12 is a front elevation view of the toner cartridge with an end cap removed and installed in the tray according to one example embodiment.

With reference back to FIGS. 7-9, toner cartridge 200 includes one or more electrical contacts 224 positioned on the outer surface of end wall 207. Electrical contacts 224 are positioned generally orthogonal to lengthwise dimension 205. In one embodiment, electrical contacts 224 are positioned on a printed circuit board 226 that also includes processing circuitry 201. Processing circuitry 201 may provide authentication functions, safety and operational interlocks, operating parameters and usage information related to toner cartridge 200. Electrical contacts 224 are positioned to contact corresponding electrical contacts 414 when toner cartridge 200 is installed in tray 400 in order to facilitate communications link 162 with controller 102, Toner cartridge 200 also includes a positioning wing 228, 230 on each side 204*c* 204*d* of wall 204. Positioning wings 228, 230 extend along lengthwise dimension 205 between front end 208 and rear end 210. With reference to FIG. 12, toner cartridge 200 is shown with positioning wings 228, 230 resting on top rail surfaces 419*a*, 421*a* of loading rails 418, 420 below hold-down features 422. Loading rails 418, 420 allow toner cartridge 200 to slide into and out of tray 400 from front end 408 along lengthwise dimensions 406, 205. Hold-down features 422 provide an upper restraint for positioning wings 228, 230 and prevent vertical motion of toner cartridge 200 during operation of toner cartridge 200 in image forming device 100, 100' or vertical displacement of toner cartridge 200 during shipping. In this configuration, top rail surfaces 419*a*, 421*a* and hold-down features 422 limit the vertical movement of toner cartridge 200 in tray 400. As shown in FIG. 12, positioning wings 228, 230 are restrained in the side-to-side direction by outer side restraints 419*b*, 421*b* to limit the side-to-side movement of toner cartridge 200 in tray 400.

With reference back to FIGS. 7-9, where tray 400 includes a keying structure 426 such as slot 428 (FIG. 5), toner cartridge 200 may include a complementary keying structure 24( )to prevent toner cartridge 20( )from being inserted into the wrong tray 400 based on the color of toner contained in toner cartridge 200. For example, keying structure 240 may include a rib 242 that projects from wall 204 near front end 208 or from end cap 212 having one of four positions around the outer surface of wall 204 based on the color of toner contained therein. Accordingly, if a user attempts to insert a toner cartridge 200 into the wrong tray 400, the toner cartridge 200 will not fit because the keying structure 240 of the toner cartridge 200 will not match the keying structure 426 of the tray 400.

Figure 13:
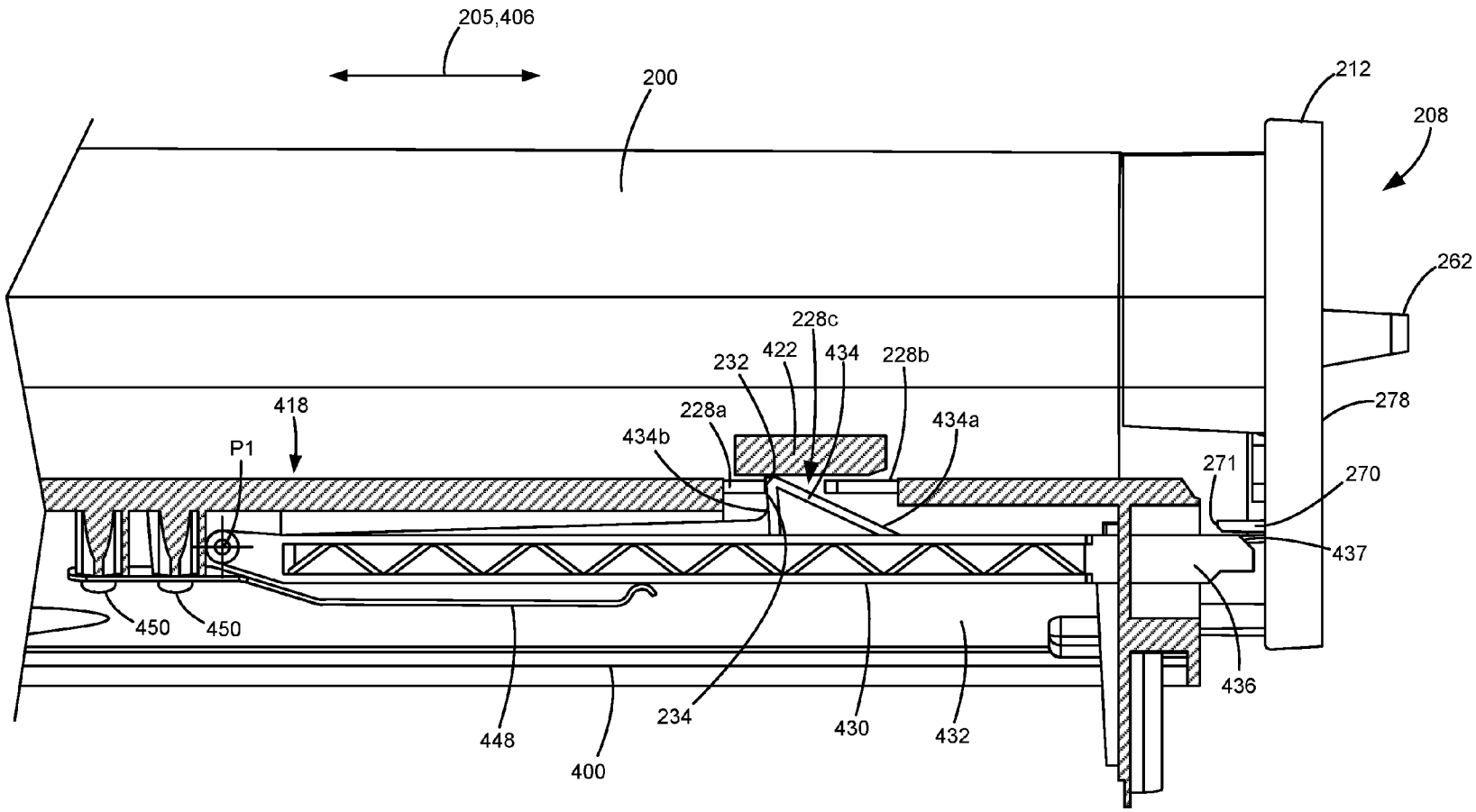
FIG. 13 is a side cutaway view of the toner cartridge restrained in the tray by a latch according to one example embodiment.

With reference to FIG. 13, toner cartridge 200 includes a latch catch 232 that receives latch 430 of tray 400 in order to restrain toner cartridge 200 from moving in a forward direction toward front end 408 along lengthwise dimension 205 in tray 400 and to removably affix toner cartridge 200 to tray 400. In the example embodiment illustrated, latch catch 232 is formed on positioning wing 228. Specifically, in this embodiment, positioning wing 228 includes two wing members 228*a*, 228*b* extending along lengthwise dimension 205. In this embodiment, wing member 228*b* is positioned in front of wing member 228*a* with a cutout 228*c* formed along lengthwise dimension 205 between wing member 228*a* and wing member 228*b*. In this embodiment, latch catch 232 includes a front end surface 234 of wing member 228*a* that engages fin 434 of latch 430 to secure toner cartridge 200 in tray 400. It will be appreciated that positioning wings 228, 230 and latch catch 232 may take any suitable shape as desired in order to position and secure toner cartridge 200 in tray 400. In the example embodiment shown, wing members 228*a* and 228*b* and positioning wing 230 are formed as ribs that project from the sides of wall 204. In another embodiment, wing member 228*b* is omitted such that positioning wing 228 includes only wing member 228*a*. In another embodiment, the length of wing member 228*a* is significantly less. Wing member 228*a* may also utilize various other shapes as desired such as a rounded peg or a curved rib. Similarly, positioning wing 230 may include one or more straight or curved ribs of different lengths or the same length, one or more pegs, etc.

Figure 14:
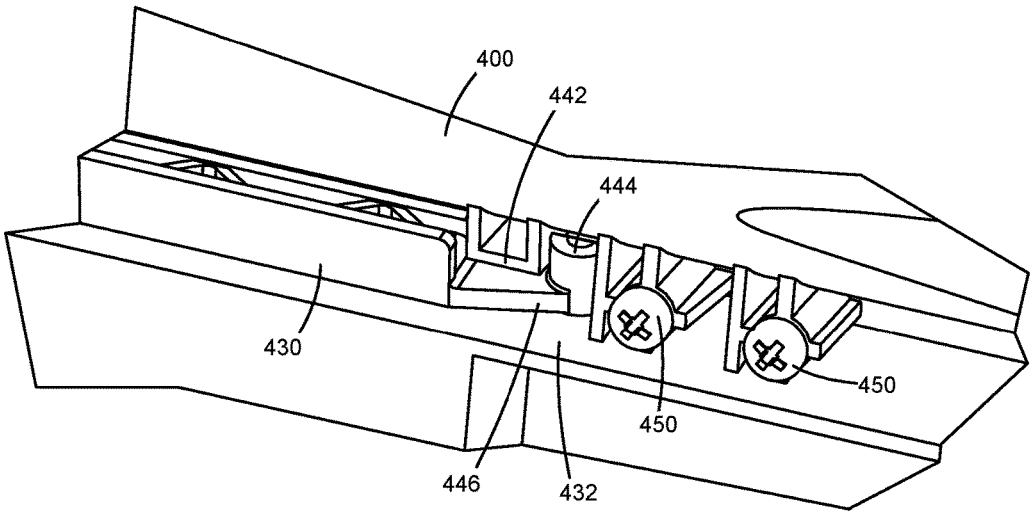
FIG. 14 is a bottom perspective view of the inside of a channel of the tray showing a pivot point of the latch of FIG. 13 according to one example embodiment.
Figure 15:
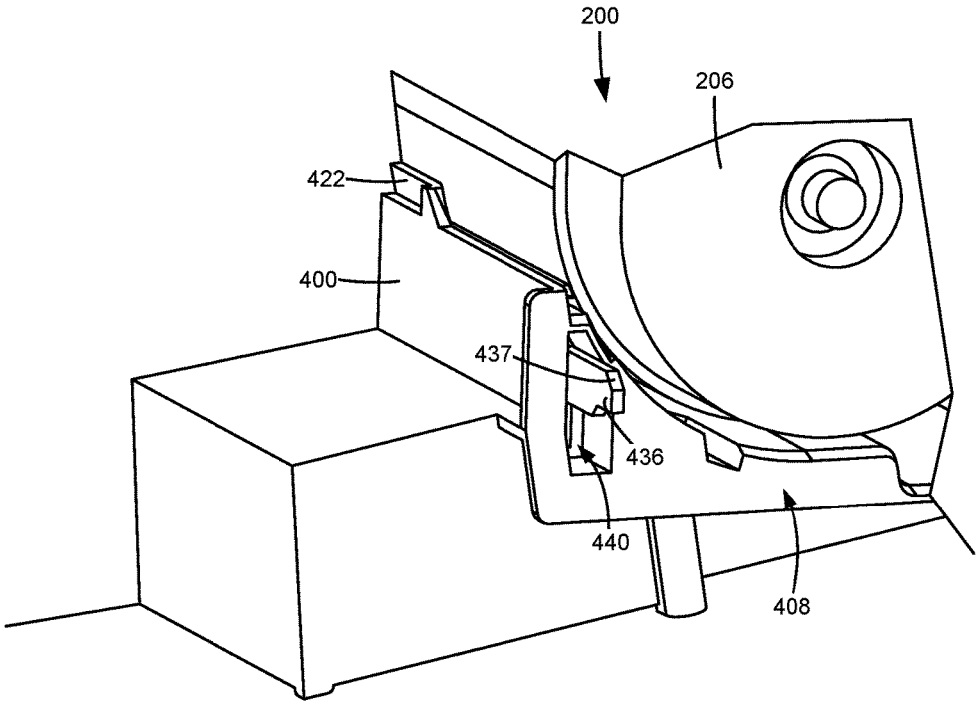
FIG. 15 is a front perspective view of the tray holding the toner cartridge with an end cap removed showing a distal end of the latch exposed to receive an actuation force according to one example embodiment.

Latch 430 is pivotable about a pivot point P1 between a latched position shown in FIG. 13 with fin 434 in the insertion path of positioning wing 228 in loading rail 418 and an unlatched position (FIGS. 20 and 27) with fin 434 clear of the insertion path of positioning wing 228 in loading rail 418. In the example embodiment illustrated, latch 430 pivots up and down between the latched position and the unlatched position such that fin 434 extends upward through top rail surface 418*a* of loading rail 418 in the latched position. Alternatively, latch 430 may pivot from side-to-side and fin 434 may extend through outer side restraint 418*b* in the latched position. FIG. 14 shows the inside of channel 432 looking up at latch 430. In one embodiment, channel 432 includes a U-shaped restraining wall 442 that retains a cylindrical pivot 444 at a proximal end 446 of latch 430. Restraining wall 442 permits latch 430 to pivot but restrains the movement of pivot 444 in the front-to-rear and side-to-side directions in channel 432. With reference back to FIG. 13, latch 430 is biased toward the latched position by a biasing member such as a cantilevered spring 448. In the example embodiment illustrated, spring 448 is positioned in channel 432 and mounted to tray 400 by fasteners 450 such as screws, rivets, etc. Alternatively, the biasing member may include a compression or extension spring attached at one end to latch 430 and at another end to an inner surface of channel 432 or a torsion spring positioned about pivot point P1. With reference to FIG. 15, in one embodiment, arm 436 of latch 430 extends forward through an elongated guide slot 440 that limits the motion of latch 430 between the latched position and the unlatched position and restricts latch 430 from moving perpendicular to guide slot 440 (i.e., the side-to-side direction in the example embodiment illustrated). Arm 436 is exposed at front end 408 of tray 400 through guide slot 440 in order to receive an actuation force to overcome the bias applied by spring 448 to move latch 430 from the latched position to the unlatched position in order to release toner cartridge 200 from tray 400 as discussed in greater detail below.

With reference back to FIG. 13, fin 434 includes an angled or ramped front camming surface 434*a*. Front camming, surface 434*a* of fin 434 allows positioning wing 228 to cam latch 430 toward the unlatched position when toner cartridge 200 is inserted into tray 400 and positioning wing 228 contacts front surface 434*a* of fin 434. Fin 434 also includes a rear latching surface 434*b* that is positioned to contact latch catch 232 of toner cartridge 200 in order to retain toner cartridge 200 in tray 400 when latch 430 is in the latching position. In one embodiment, rear latching surface 434*b* is angled rearward with respect to the body of latch 430 in order to direct the force on rear latching surface 434*b* from latch catch 232 when toner cartridge 200 is installed in tray 40( )through pivot point P1 of latch 430. This prevents latch 430 from inadvertently unlatching during extreme conditions such as if image forming device 100, 100' is dropped. In another embodiment, rear latching surface 434*b* is generally perpendicular to the body of latch 430; however, in this embodiment; latch 430 may be prone to unlatching during extreme conditions.

Figure 16:
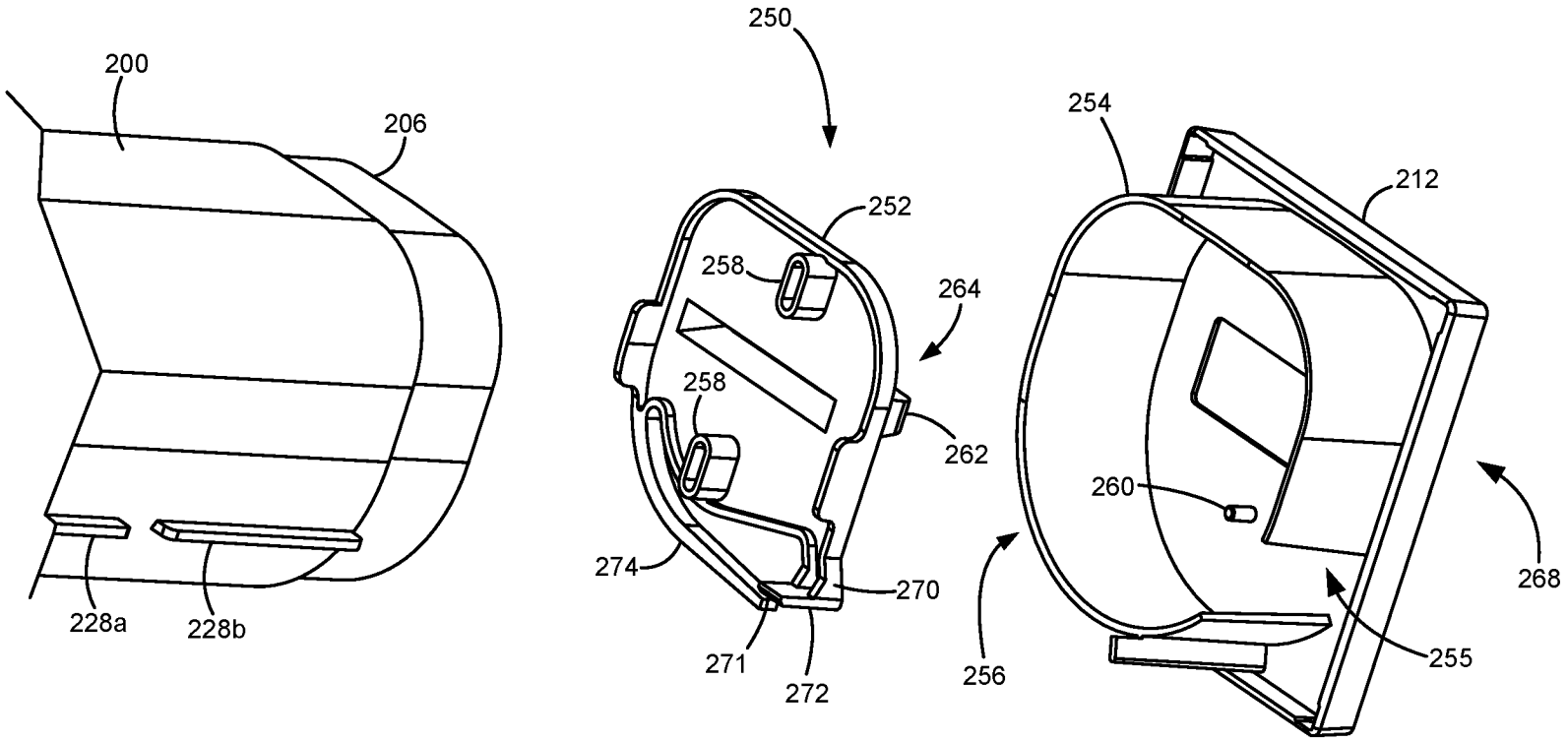
FIG. 16 is an exploded view of the toner cartridge showing a latch release mechanism according to a first example embodiment.
Figure 17:
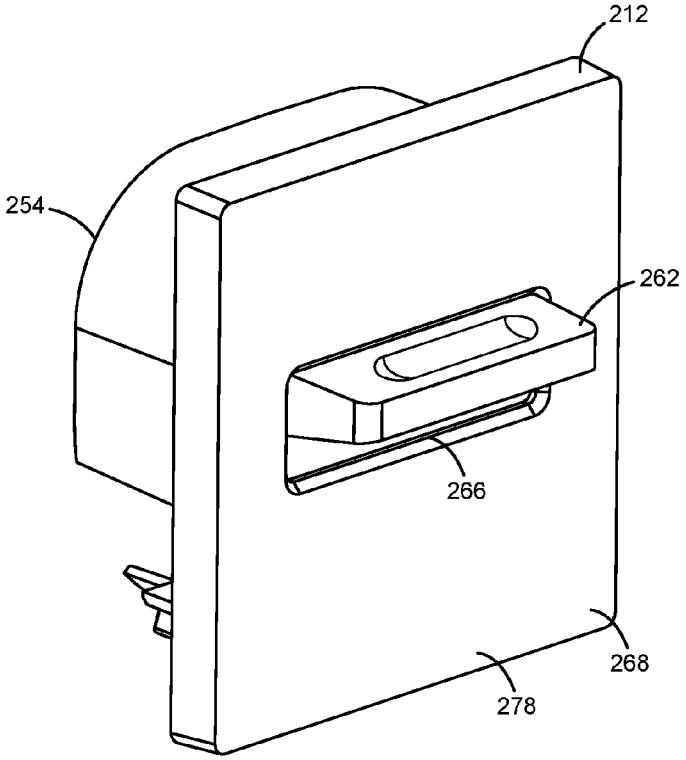
FIG. 17 is a front perspective view of a latch actuator coupled with an end cap of the toner cartridge according to one example embodiment.
Figure 18:
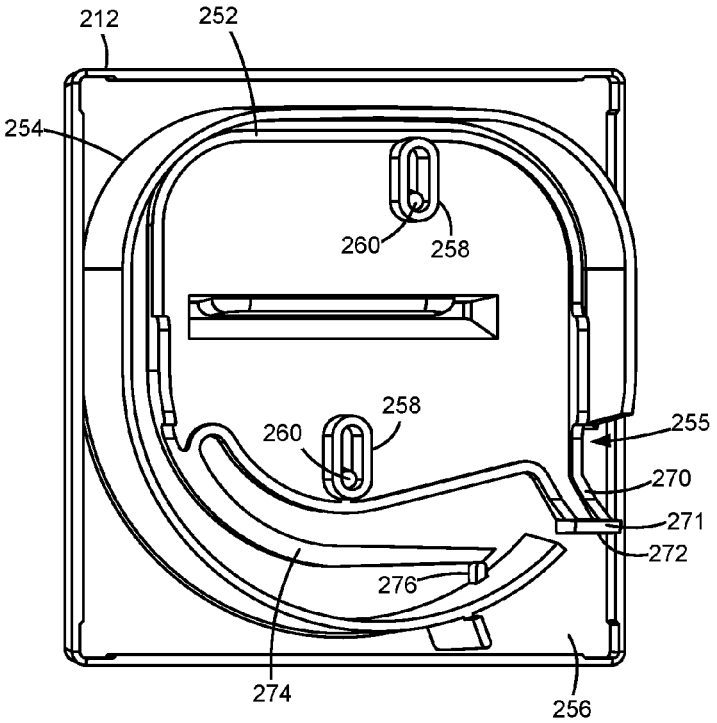
FIG. 18 is a rear perspective view of the latch actuator shown in FIG. 17 coupled with the end cap.

FIG. 16 shows an exploded view of a release mechanism 25( )that is used to release toner cartridge 200 from tray 400. Release mechanism 250 includes a latch actuator 252 positioned between end wall 206 and end cap 212, FIGS. 17 and 18 show front and rear views, respectively, of latch actuator 252 coupled with end cap 212 according to one embodiment. Latch actuator 252 is loosely retained within a skirt 254 on a rear side 256 of end cap 212. Latch actuator 252 includes one or more guide slots 258 that receive corresponding guide posts 26( )on rear side 256 of end cap 212. Guide slots 258 are elongated to permit latch actuator 252 to move relative to end cap 212. For example, in the embodiment illustrated, latch actuator 252 translates up and down relative to end cap 212; however, motion in other directions (e.g., rotation, translation in other directions, etc.) may be used as desired. The height of guide slots 258 limits the amount of travel of latch actuator 252 relative to end cap 212. The engagement between guide slots 258 and guide posts 260 also guards against breakage of latch actuator 252 or end cap 212 caused by excessive force applied to latch actuator 252 by a user. Although the example embodiment illustrated shows latch actuator 252 having guide slots 258 and end cap 212 having guide posts 260, this configuration may be reversed as desired such that latch actuator 252 includes guide posts and end cap 212 includes elongated guide slots.

A release handle 262 extends from a front side 264 of latch actuator 252 through a slot 266 in end cap 212 such that handle 262 is exposed on a front side 268 of end cap 212 in order to permit a user to engage handle 262. In the example embodiment illustrated, handle 262 and slot 266 are generally horizontal; however, other configurations may be used as desired as discussed in greater detail below. In the embodiment illustrated, slot 266 is elongated vertically with respect to handle 262 so that handle 262 is free to translate up and down within slot 266 as guide posts 260 travel within guide slots 258; however, other directions of motion may be used as desired.

An actuation foot 270 extends downward from a bottom portion of latch actuator 252 near the side of body 203 having positioning wing 22.8 (proximate to loading rail 418 and latch 430 when toner cartridge 200 is installed in tray 400). Actuation foot 270 includes a downward facing contact surface 272 that extends rearward toward end wall 207. Actuation foot 270 is positioned to engage arm 436 of latch 430 from above in order to move latch 430 from the latched position to the unlatched position to release toner cartridge 200 from tray 400. Skirt 254 includes a cutout 255 that permits actuation foot 270 to extend beyond skirt 254 in order to contact arm 436.

Figure 27:
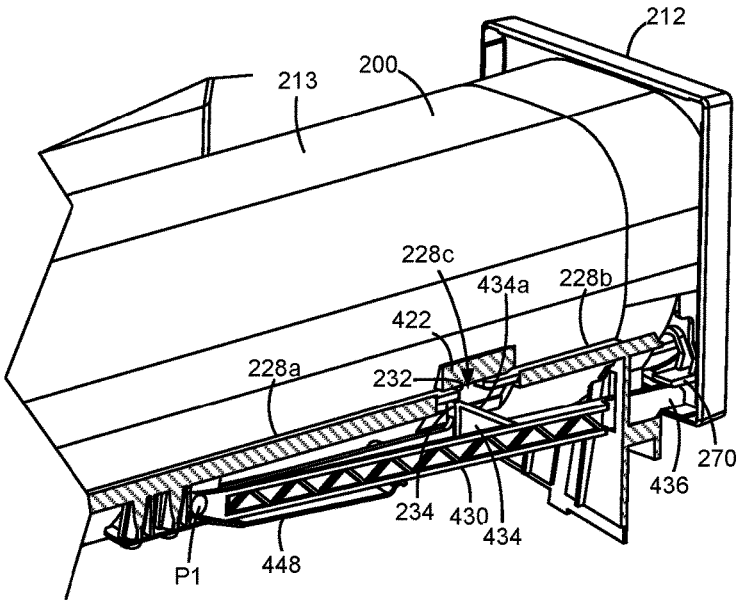
FIG. 27 is a perspective view of the toner cartridge when a release handle is pressed to release the toner cartridge from the tray according to one example embodiment.

Latch actuator 252 is movable between a home position shown in FIG. 18 and a releasing position (FIG. 27). In one embodiment, a cantilevered bias arm 274 of latch actuator 252 biases latch actuator 252 toward the home position. Bias arm 274 is resiliently deflectable by a rib 276 or a portion of skirt 254. Bias arm 274 biases latch actuator 252 upward with respect to end cap 212 and, in turn, actuation foot 270 upward. When a user presses down on release handle 262 overcoming the bias applied by arm 274, rib 276 or skirt 254 deflects bias arm 274 and latch actuator 252 including actuation foot 270 translates downward with respect to end cap 212 and body 203 from the home position to the releasing position. When a user releases handle 262, the bias applied by arm 274 returns latch actuator 252 including actuation foot 270 upward to the home position. The engagement between guide posts 260 and guide slots 258 controls the movement of latch actuator 252 relative to end cap 212. In other embodiments, latch actuator 252 is biased toward the home position by one or more springs.

In one embodiment, actuation foot 270 includes a tapered lead-in 271 at the rear end of actuation foot 270 and arm 436 includes a tapered lead-in 437 (FIG. 15) at the front end of arm 436 in order to ensure that actuation foot 270 is positioned above arm 436 when toner cartridge 200 is installed in tray 400. Otherwise, if toner cartridge 200 was inserted into tray 400 with latch actuator 252 depressed to the releasing position, actuation foot 27( )could tend to crash against arm 436 of latch 430 before toner cartridge 200 is fully seated in tray 400.

Figure 19:
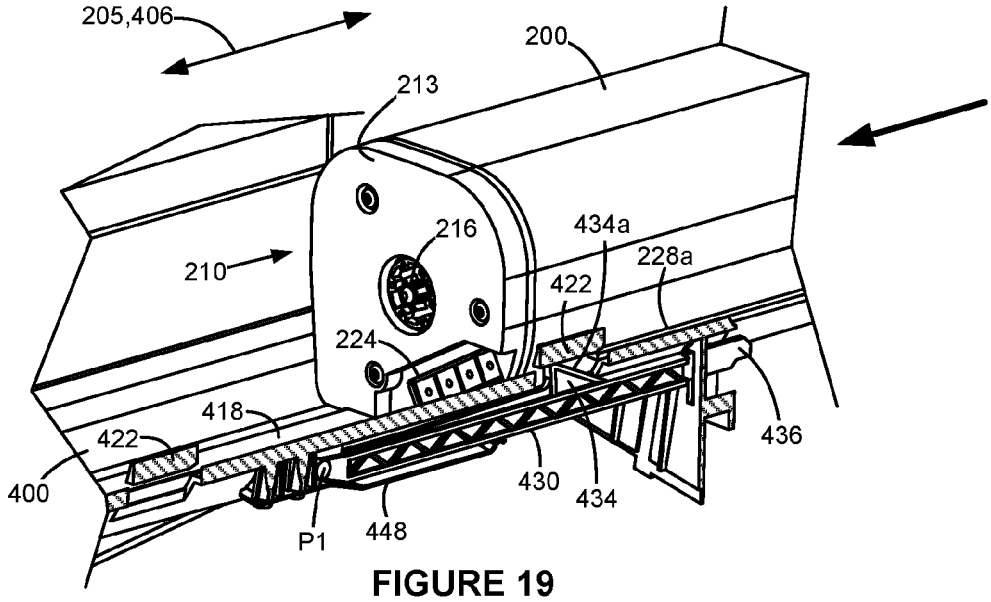
FIG. 19 is a perspective view of the toner cartridge as it is first inserted into the tray according to one example embodiment.

FIGS. 19-29 are sequential views illustrating the insertion and removal of toner cartridge 200 into and out of tray 400 according to one embodiment. FIG. 19 shows toner cartridge 200 as it is first inserted into the corresponding tray 400. Rear end 210 of toner cartridge 200 is inserted into the open front end 408 of tray 400 into cartridge storage area 402 with positioning wings 228, 230 positioned on loading rails 418, 420. The user pushes toner cartridge 200 toward rear end 410 of tray 400 with positioning wings 228, 230 sliding along loading rails 418, 420. Outer side restraints 419*b*, 421*b* (FIG. 12) limit the side-to-side travel of toner cartridge 200 as toner cartridge 200 advances toward rear end 410. Top rail surfaces 419*a*, 421*a* of loading rails 418, 420 control the vertical position of toner cartridge 200 in tray 400. As toner cartridge 200 advances, positioning wings 228, 230 pass under hold-down features 422, which prevent toner cartridge 200 from rotating vertically as toner cartridge 200 is inserted. FIG. 19 shows wing member 228*a* passing under the hold-down feature 422 of loading rail 418 proximate front end 408 of tray 400 and approaching front camming surface 434*a* of fin 434 of latch 430.

Figure 20:
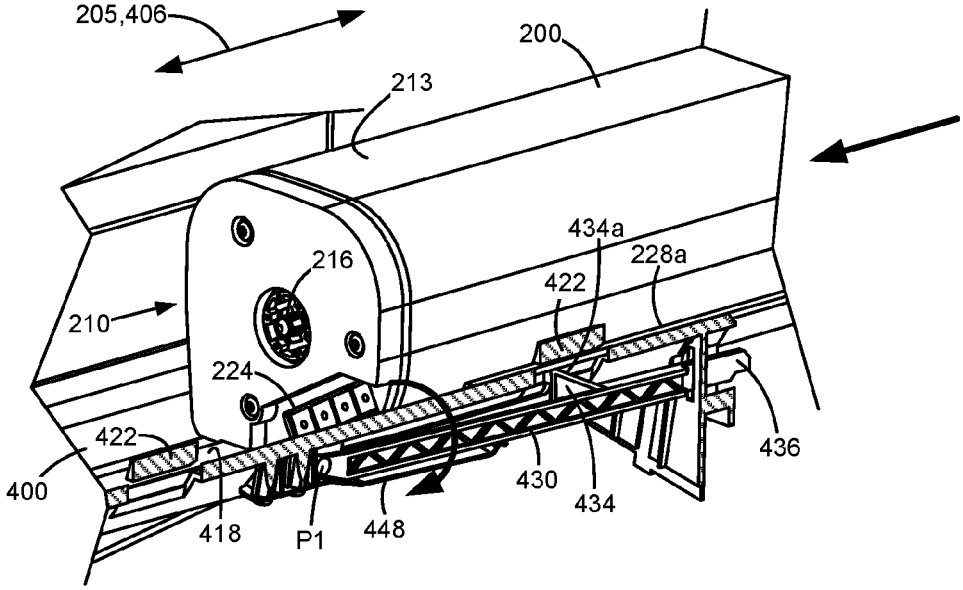
FIG. 20 is a perspective view of the toner cartridge as it advances further into the tray according to one example embodiment.

FIG. 20 shows toner cartridge 200 as it advances further into tray 400 toward rear end 410. As shown in FIG. 20, when positioning wing 228 (wing member 228*a*) contacts front camming surface 434*a* of fin 434, the insertion force from toner cartridge 200 overcomes the biasing force applied to latch 430 causing latch 430 to pivot from the latched position to the unlatched position (clockwise as viewed in FIG. 20).

Figure 21:
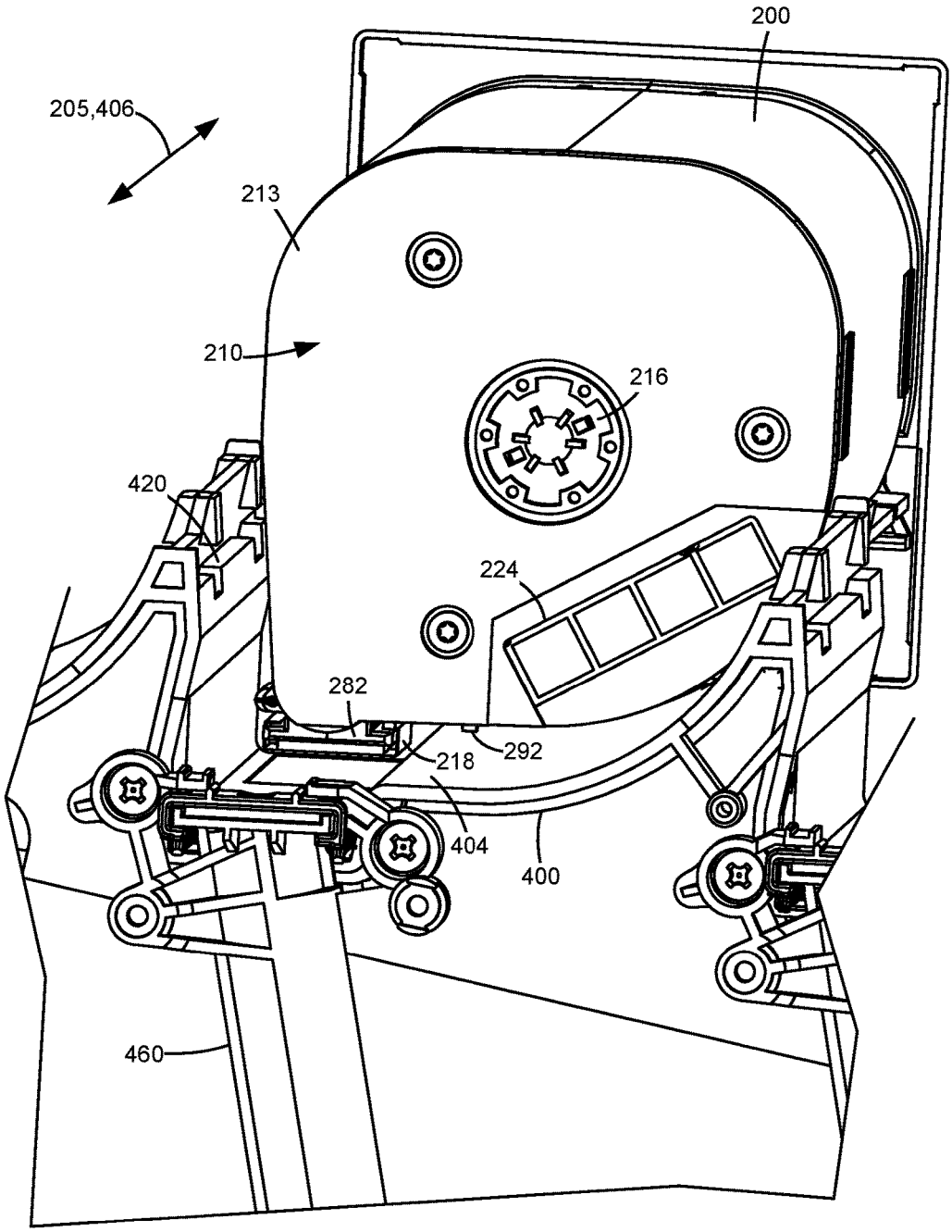
FIG. 21 is a perspective view of the toner cartridge advanced further into the tray nearing the end of the tray according to one example embodiment.

FIG. 21 shows toner cartridge 200 advanced further into tray 400 toward rear end 410. In one embodiment, the portions of top rail surfaces 419*a*, 421*a*, of loading rails 418, 420 near rear end 410 (e.g., toward rear end 410 from the hold-down features 422 proximate to rear end 410) have a height that is lower than (e.g., by about 1 mm) the portions of top rail surfaces 419*a*, 421*a* near front end 408 (e.g., toward front end 408 from the hold-down features 422 proximate to rear end 410). As toner cartridge 200 nears rear end 410, positioning bump 292 contacts and rides along top surface 404 of tray 400. The engagement between positioning bump 292 and top surface 404 of tray 400 controls the vertical position of rear end 210 of toner cartridge 200 as toner cartridge nears rear end 410 of tray 400. The engagement between positioning wings 228, 230 and top rail surfaces 419*a*, 421*a* of loading rails 418, 420 controls the vertical position of front end 208 of toner cartridge 200.

Figure 22:
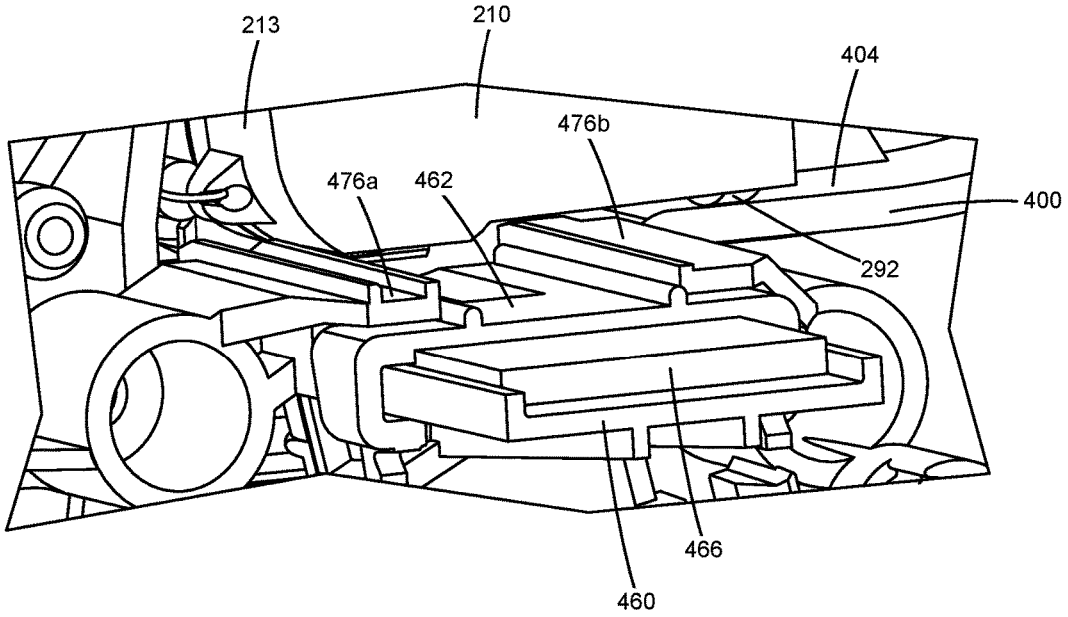
FIG. 22 is a perspective view of the toner cartridge advanced further into the tray with a positioning bump positioned on a top surface of the tray according to one example embodiment.
Figure 23:
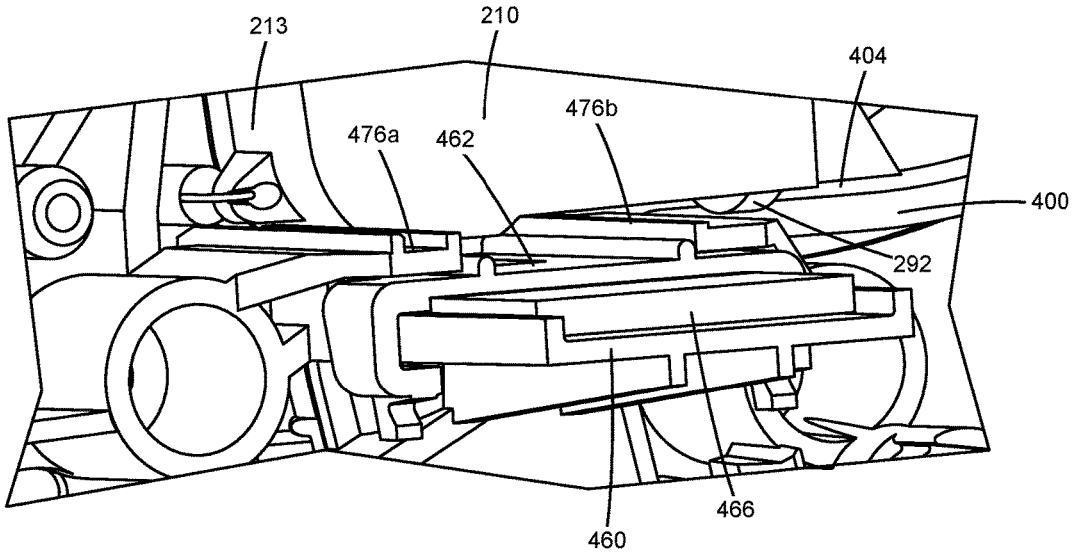
FIG. 23 is a perspective view of the toner cartridge advanced further into the tray after the positioning bump has passed and fallen off the top surface of the tray according to one example embodiment.

FIG. 22 shows positioning bump 292 and the area surrounding outlet port 214 in greater detail as toner cartridge 200 nears its final operating position in tray 400. Positioning bump 292 is positioned on top surface 404 of tray 400 at the rear edge of top surface 404. The engagement between positioning bump 292 and top surface 404 positions toner cartridge 200 vertically high enough for rear end 210 of toner cartridge (e.g., end cap 213) to pass over the top of toner chute 460, in particular to pass over the top of ledges 476*a* and 476*b*. FIG. 23 shows toner cartridge 200 advanced further toward the final operating position of toner cartridge 200 in tray 400 with toner cartridge 200 advanced far enough for positioning bump 292 to pass and fall off of the rear edge of top surface 404 of tray 400. After positioning bump 292 falls off of the rear edge of top surface 404, top rail surfaces 419*a*, 421*a* of loading rails 418, 420 control the vertical position of front end 208 of toner cartridge 200, contact between the bottom of end cap 213 on top of shutter 462 controls the vertical position of rear end 210 of toner cartridge 200 and outer side restraints 419*b*, 421*b* control the side-to-side position of toner cartridge 200 so that extension 282 is aligned with and enters channel 470 of toner chute 460 as toner cartridge 200 advances.

Figure 24:
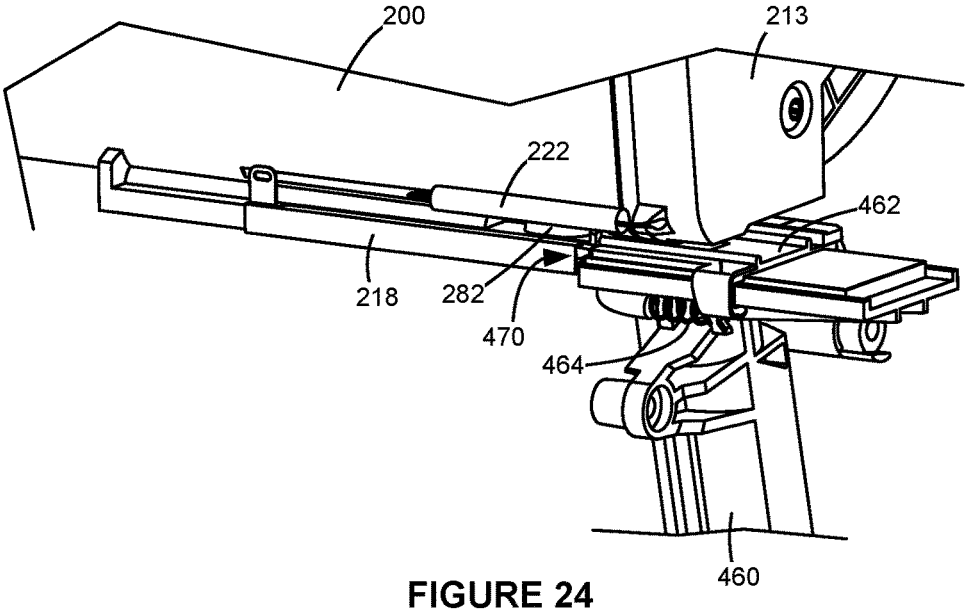
FIG. 24 is a perspective view of the toner cartridge engaging the toner chute according to one example embodiment.
Figure 25:
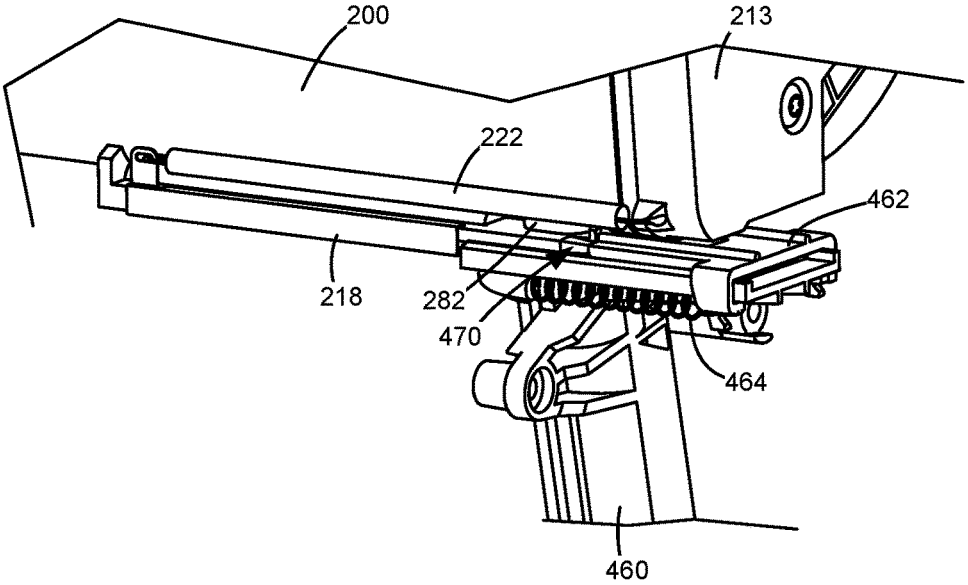
FIG. 25 is a perspective view of the toner cartridge fully advanced and seated in its final operating position in the tray with the outlet port of the toner cartridge mated with the inlet port of the toner chute according to one example embodiment.

FIG. 24 shows toner cartridge 200 engaged with toner chute 460 as extension 282 enters channel 470. Specifically, ledges 284 and 285 of extension 282 pass below ledges 476*a* and 476*b*, above top surface 472 of toner chute 460 and between walls 474*a* and 474*b*. Chute 283 passes between ledges 476*a* and 476*b*. Ledges 476*a* and 476*b* of toner chute 460 enter pockets 286 and 287 below bottom surface 288 of toner exit section 280. As toner cartridge 200 advances further, a rear face of extension 282 positioned in channel 470 contacts a front face of shutter 462 and overcomes the biasing force applied to shutter 462 by spring(s) 464 to open shutter 462 as toner cartridge 200 advances. At substantially the same time, a portion of toner chute 460 such as ledge 476*b* in the example embodiment illustrated contacts actuation tab 220 of shutter 218 of toner cartridge 200 and overcomes the biasing force applied to shutter 218 by spring(s) 222 to open shutter 218 as toner cartridge 200 advances. As shutters 218 and 462 moved from their closed positions to their open positions, outlet port 214 moves into alignment with inlet port 416. FIG. 25 shows toner cartridge 200 fully advanced and seated in its final operating position in tray 400 with outlet port 214 mated and aligned with inlet port 416. In the embodiment illustrated, seal 466 provides a sealing force between extension 282 and top surface 472 of toner chute 460 to push the top surfaces of ledges 284 and 285 against the bottom surfaces of ledges 476*a* and 476*b*. In this manner, the engagement between the top surfaces of ledges 284 and 285 against the bottom surfaces of ledges 476*a* and 476*b* controls the vertical position of rear end 210 of toner cartridge 200 when extension 282 is positioned in channel 470 of toner chute 460 including when toner cartridge 200 is in its final operating position. As discussed above, in another embodiment, seal 290 provides this sealing force. Top rail surfaces 419*a*, 421*a* of loading rails 418, 420 control the vertical position of front end 208 of toner cartridge 200.

Figure 26:
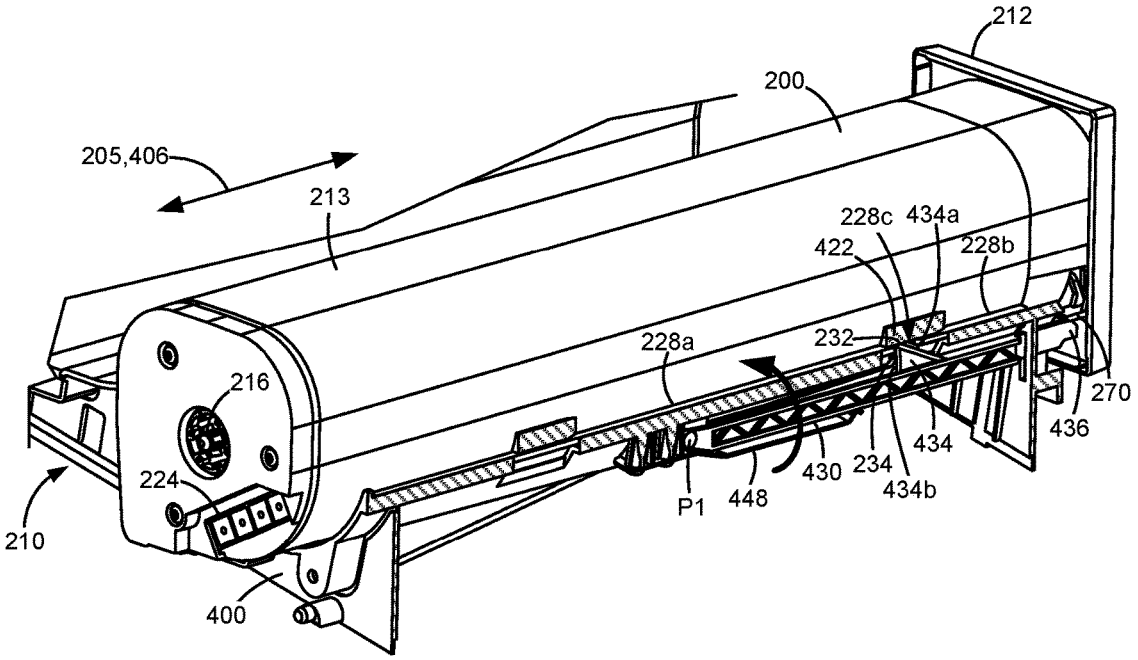
FIG. 26 is a perspective view of the toner cartridge fully advanced and seated in its final operating position in the tray according to one example embodiment.

FIG. 26 is a perspective view of toner cartridge 200 fully advanced and seated in its final operating position in tray 400. As toner cartridge 200 reaches its final position, fin 434 of latch 430 reaches latch catch 232 causing latch 230 to return to the latched position from the unlatched position as a result of the bias applied by spring 448. Specifically, in the example embodiment illustrated, wing member 228*a* clears fin 434 causing latch 230 to pivot about pivot point PT to the latched position (counterclockwise as viewed in FIG. 26) and fin 434 to protrude into cutout 228*c*. When latch 430 returns to the latched position, an audible clicking noise is produced by fin 434 snapping into cutout 228*c* providing the user with feedback that toner cartridge 200 is correctly seated.

When toner cartridge 200 reaches its final position, drive element 216 mates with corresponding drive element 412 to receive rotational power, electrical contacts 224 mate with corresponding electrical contacts 414 in order to establish communications link 162 between processing circuity 201 and controller 102, and outlet port 214 aligns with inlet port 416 to permit toner to transfer from reservoir 202 of toner cartridge 200 to reservoir 302 of imaging unit 300, 300'. With toner cartridge 200 installed and latch 430 in the latched position, rear latching surface 434*b* of fin 434 prevents front end surface 234 of wing member 228*a* and toner cartridge 200 from advancing toward front end 408 thereby locking toner cartridge 200 into the operating position until latch 430 is moved to the unlatched position. In one embodiment, drive element 412 meshes with the outer axial end of drive element 216 and the rotational axis of drive element 412 is substantially in line with the rotational axis of drive element 216. For example, drive element 412 may include an Oldham coupler or the like that is biased axially toward drive element 216 such that drive element 412 applies an axial force in the forward direction toward front end 408 along lengthwise dimension 406, 205 to rear end 210 of toner cartridge 200. In one embodiment, electrical contacts 414 are also biased along lengthwise dimension 406, 205 against rear end 210 of toner cartridge 200 such that electrical contacts 414 apply a force in the forward direction along lengthwise dimension 406, 205 against electrical contacts 224 of toner cartridge 200. In one embodiment, shutter 462 is biased along lengthwise dimension 406, 205 against extension 282 in the forward direction. Further, when shutter 218 is slid from the closed position to the open position and extension spring(s) 222 are stretched, a force is applied to toner cartridge 200 along lengthwise dimension 406, 205 in the forward direction. These forces along lengthwise dimension 406, 205 in the forward direction toward front end 408 of tray 400 and front end 208 of toner cartridge 200 press front end surface 234 of latch catch 232 into engagement with rear latching surface 434*b* of fin 434 of latch 430 thereby controlling the front-to-rear position of toner cartridge 200 in tray 400.

FIG. 27 shows toner cartridge 20( )when release handle 262 is pressed and latch actuator 252 is moved from the home position to the releasing position in order to release toner cartridge 20( )from tray 400. When release handle 262 is pressed downward by the user overcoming the bias applied to latch actuator 252 by bias arm 274, latch actuator 252 slides downward between end wall 206 and end cap 212 causing bias arm 274 to deflect. The engagement between guide slots 258 and guide posts 260 guides the motion of latch actuator 252. As latch actuator 252 moves to the releasing position, actuation foot 270 lowers and pushes arm 436 of latch 430 downward overcoming the bias applied to latch 43( )by spring 448 and causing latch 430 to pivot from the latched position to the unlatched position. As latch 430 moves from the latched position to the unlatched position, fin 434 clears latch catch 232. When fin 434 clears latch catch 232, toner cartridge 200 is no longer restrained in the front-to-rear direction by latch 430. As a result, when latch 430 is moved to the unlatched position, the user is free to remove toner cartridge 200 from tray 400 by pulling toner cartridge 200 forward toward the user.

Figure 28:
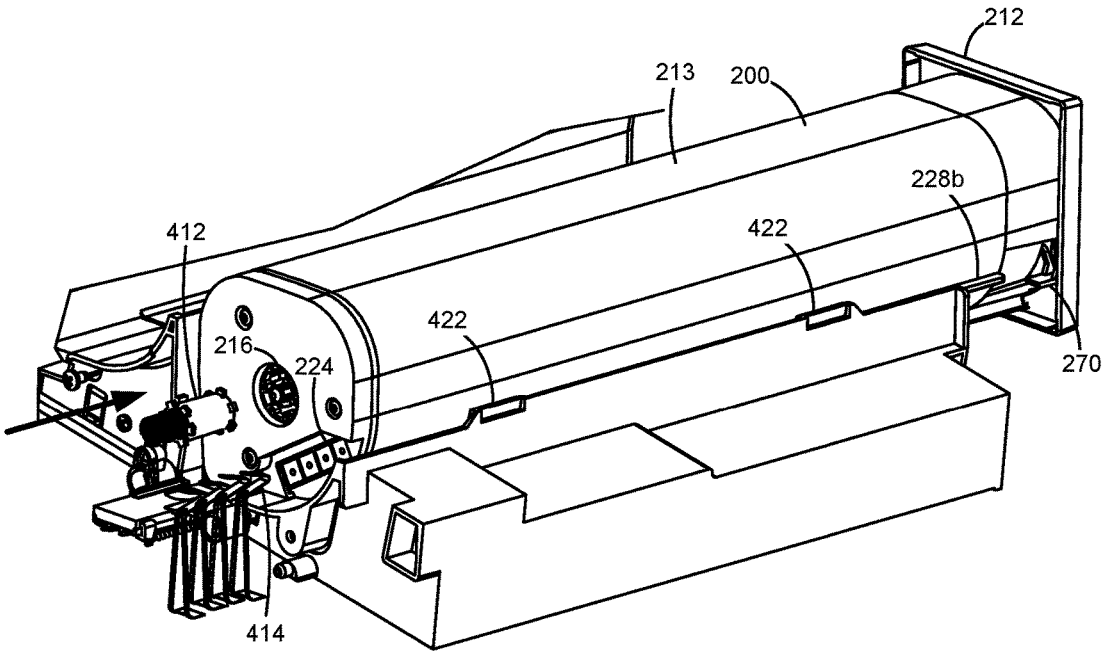
FIG. 28 is a perspective view of the toner cartridge advancing out of the tray according to one example embodiment.

As shown in FIG. 28, where toner cartridge 20( )is biased in the direction of front end 208 such as by drive element 412, electrical contacts 414, shutter 462 and shutter 218, when latch 430 is moved to the unlatched position and fin 434 clears latch catch 232, the force on toner cartridge 200 in the forward direction along lengthwise dimension 406, 205 causes toner cartridge 200 to travel forward toward front end 408 without requiring force from the user other than the force to press release handle 262. In this manner, toner cartridge 200 moves forward and presents itself to the user for removal thereby providing feedback to the user that toner cartridge 200 is unlatched and ready for removal and assisting the user with the removal by advancing toner cartridge 200 part of the way out of tray 400. Specifically, in the embodiment illustrated, the force on rear end 21( )of toner cartridge 200 applied by drive element 412 on drive element 216, by electrical contacts 414 on electrical contacts 224, and by shutter 462 on extension 282 pushes toner cartridge 200 toward front end 408. Further, the spring force of spring(s) 222 urges toner cartridge 200 toward front end 408. In one embodiment, toner cartridge 200 advances on the order of about 20 mm to about 50 mm forward on its own without additional user intervention when handle 262 is pressed and latch 430 moves to the unlatched position. As toner cartridge 200 advances toward front end 408 of tray 400, the biasing force from spring(s) 464 and 222 close shutters 462 and 218 to prevent toner from leaking from inlet port 416 or outlet port 214. As toner cartridge 200 continues to advance toward front end 408, extension 282 exits channel 470 and toner cartridge 200 separates from toner chute 460.

With reference to FIGS. 13 and 17, in the example embodiment illustrated, end cap 212 includes a front face 278 that blocks the user's access to arm 436 of latch 430 when toner cartridge 200 is in its final seated position in tray 400. In this embodiment, release handle 262 extending through slot 266 in end cap 212 is the only engagement feature presented to the user thereby providing an intuitive feature to the user for releasing toner cartridge 200 from tray 400.

Figure 29:
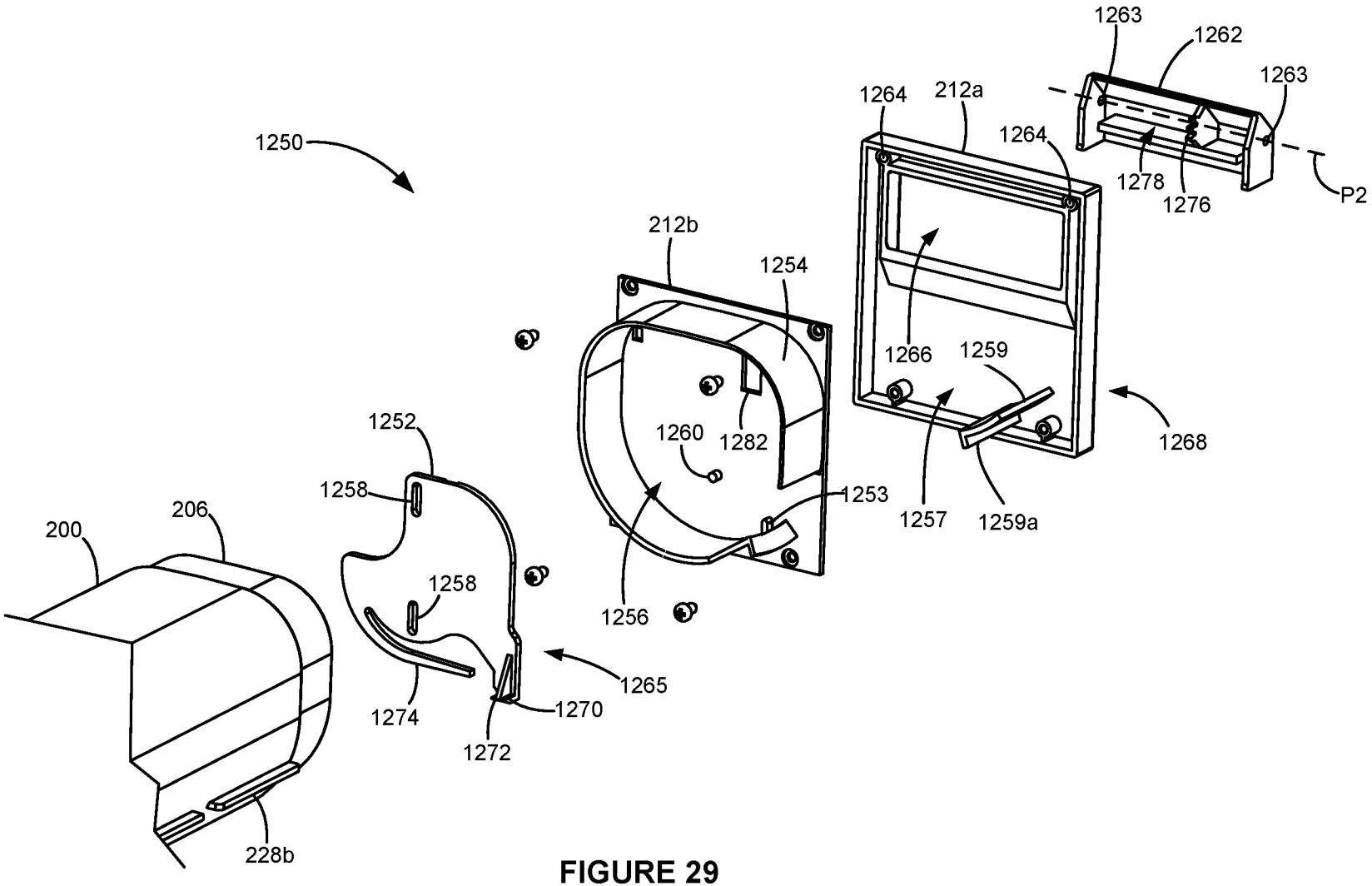
FIG. 29 is an exploded view of the toner cartridge showing a latch release mechanism according to a second example embodiment.

As discussed above, other configurations of release mechanism 250 for actuating latch 430 to release toner cartridge 200 from tray 400 may be used as desired. For example, FIGS. 29-32 show a release mechanism 1250 for use with toner cartridge 200 according to one example embodiment, FIG. 29 shows an exploded view of release mechanism 1250. In this embodiment, end cap 212 includes an outer end cap 212*a* and an inner end cap 212*b* attached to each other, for example, by suitable fasteners (e.g., screws, rivets, etc.) or by a snap-fit engagement. Release mechanism 1250 includes a latch actuator 1252 positioned between end wall 206 and inner end cap 212*b*. Latch actuator 1252 is loosely retained within a skirt 1254 on a rear side 1256 of inner end cap 212*b* and a flange 1259 having a keying rib 1259*a* on a rear side 1257 of outer end cap 212*a*. Latch actuator 1252 includes one or more guide slots 1258 that receive corresponding guide posts 1260 on rear side 1256 of inner end cap 212*b*. Again, this configuration may be reversed as desired. As discussed above, guide slots 1258 are elongated to permit latch actuator 1252 to move (e.g., up and down) relative to end cap 212.

A release handle 1262 is pivotally mounted to inner end cap 212*b* about a pivot axis P2. Release handle 1262 extends through a slot 1266 in outer end cap 212*a* such that handle 1262 is exposed on a front side 1268 of outer end cap 212*a* in order to permit a user to engage handle 1262. In the example embodiment illustrated, handle 1262 includes a pair of pivot holes 1263 that receive corresponding pivot posts 1264 on front side 1268 of outer end cap 212*a*. This configuration may be reversed as desired such that handle 1262 includes pivot posts and outer end cap 212*a* includes pivot holes. Further, release handle 1262 may be mounted to inner end cap 212*b* instead of outer end cap 212*a* as desired. In the example embodiment illustrated, handle 1262 and slot 1266 are generally horizontal and handle 1262 pivots up and down; however, other orientations may be used as desired such as mounting handle 1262 vertically and handle 1262 pivoting side-to-side. Handle 1262 includes a sector gear 1276 on a rear side 1278 of handle 1262 that engages corresponding gear teeth 1280 (FIGS. 23 and 24) on front side 1265 of latch actuator 1252. Gear teeth 1280 extend through a slot 1282 in inner end cap 212*b* in order to engage sector gear 1276 of handle 1262.

Figure 30:
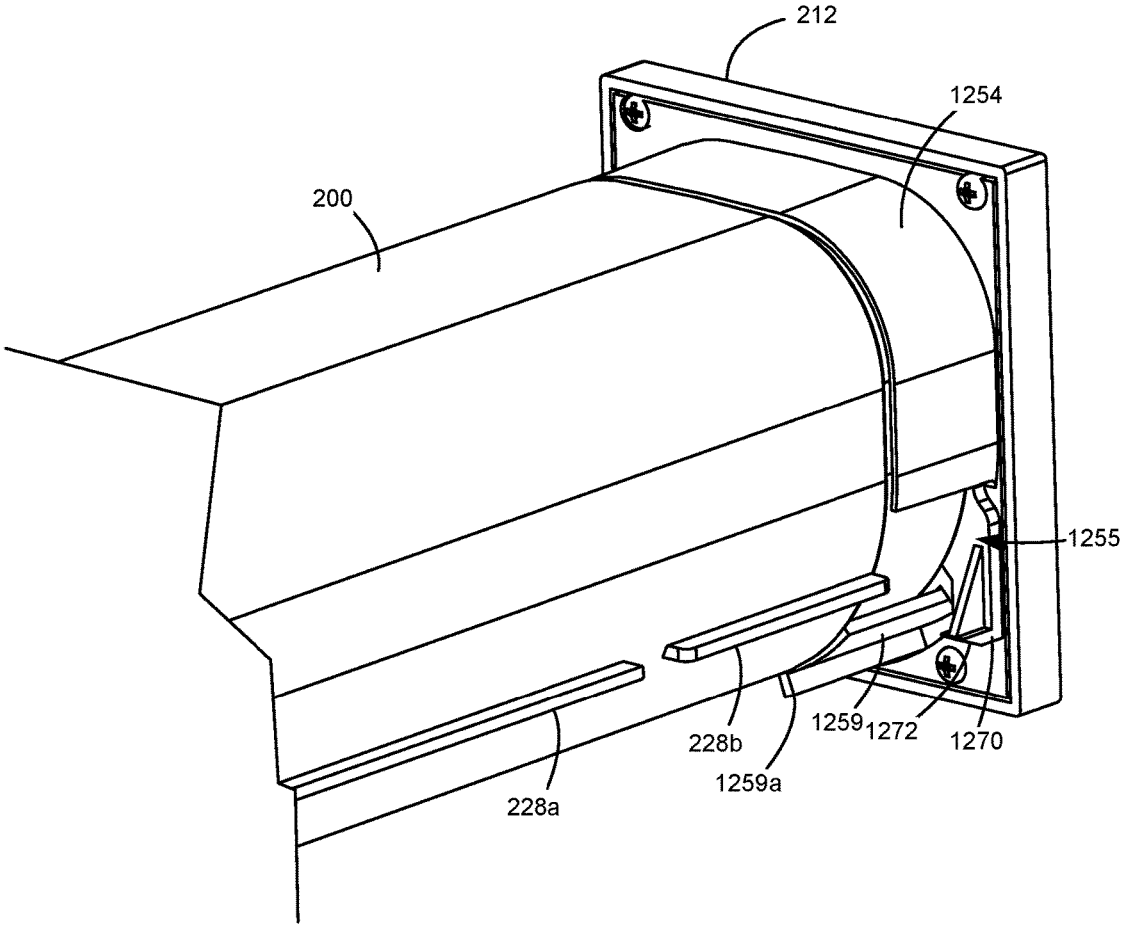
FIG. 30 is a rear perspective view of the toner cartridge having the latch release mechanism shown in FIG. 29.

With reference to FIG. 30, an actuation foot 1270 extends downward from a bottom portion of latch actuator 1252 near the side of body 203 having positioning wing 228 (proximate to loading rail 418 and latch 43( )when toner cartridge 200 is installed in tray 400). Actuation foot 1270 includes a downward facing contact surface 1272 that extends rearward toward end wall 207. Actuation foot 1270 is positioned to engage arm 436 of latch 430 from above in order to move latch 430 from the latched position to the unlatched position to release toner cartridge 200 from tray 40( )as discussed above. A gap 1255 is formed between skirt 1254 and flange 1259 that permits actuation foot 1270 to extend beyond skirt 1254 and flange 1259 in order to contact arm 436.

Figure 31:
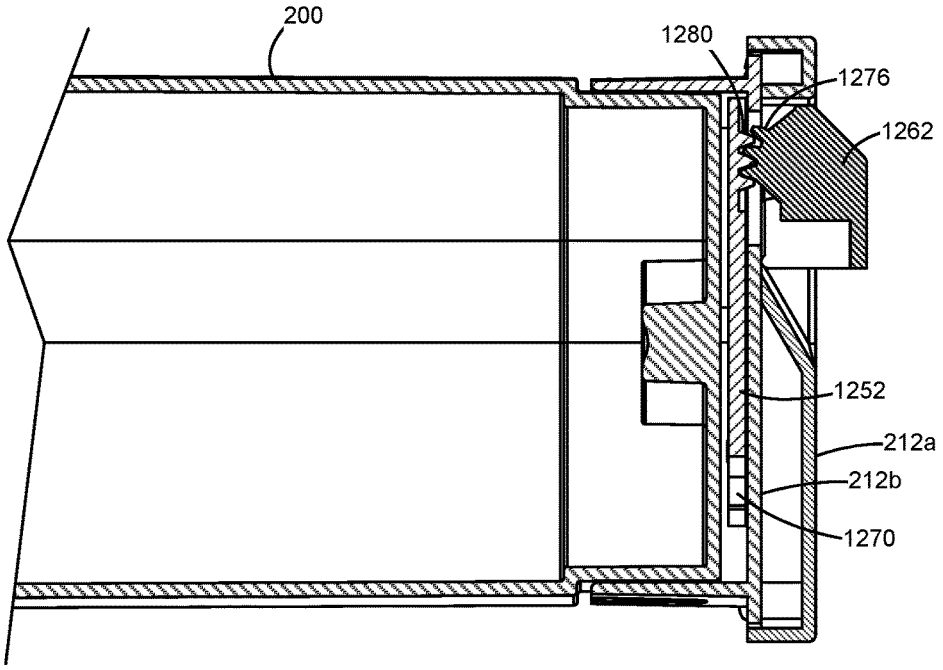
FIG. 31 is a cross-sectional view of the latch release mechanism shown in FIG. 29 in a home position.
Figure 32:
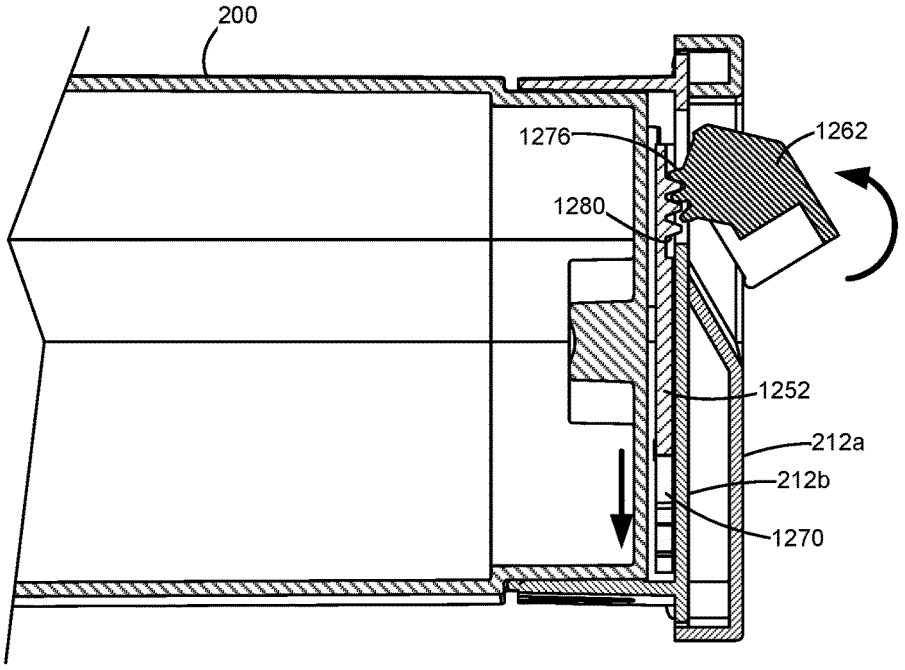
FIG. 32 is a cross-sectional view of the latch release mechanism shown in FIG. 29 in a releasing position.

Latch actuator 1252 is movable between a home position shown in FIG. 31 and a releasing position shown in FIG. 32. As shown in FIG. 29, in one embodiment, a cantilevered bias arm 1274 of latch actuator 1252 biases latch actuator 1252 toward the home position as discussed above. Bias arm 1274 is resiliently deflectable by a rib 1253 on inner end cap 212*b*. Bias arm 1274 biases latch actuator 1252 and actuation foot 1270 upward with respect to end cap 212. With reference to FIGS. 31 and 32, when a user pulls release handle 1262, handle 1262 pivots counterclockwise as viewed in FIGS. 31 and 32 and the engagement between sector gear 1276 of handle 1262 and gear teeth 128( )of latch actuator 1252 causes latch actuator 1252 to translate downward with respect to end cap 212 and body 203 from the home position (FIG. 31) to the releasing position (FIG. 32). Actuation foot 1270 lowers with latch actuator 1252 in order to engage arm 436 of latch 430 to move latch 430 from the latched position to the unlatched position as discussed above. When a user releases handle 1262, the bias applied by arm 1274 returns latch actuator 1252 including actuation foot 1270 upward to the home position and the engagement between sector gear 1276 of handle 1262 and gear teeth 1280 of latch actuator 1252 causes handle 1262 to pivot back downward (clockwise as viewed in FIGS. 31 and 32).

Figure 33:
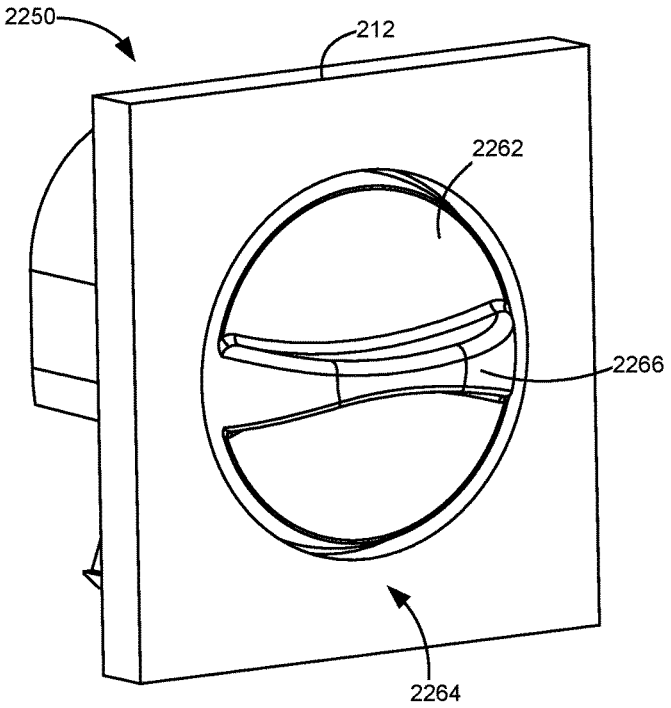
FIG. 33 is a front elevation view of the toner cartridge having a latch release mechanism according to a third example embodiment.
Figure 34:
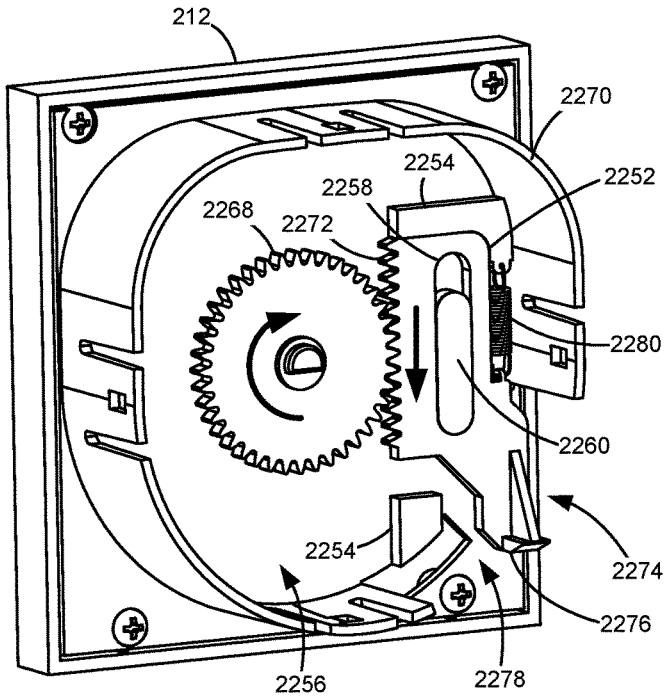
FIG. 34 is a rear elevation view of the toner cartridge having the latch release mechanism shown in FIG. 33.

FIGS. 33 and 34 show another release mechanism 2250 for use with toner cartridge 200 according to one example embodiment. Release mechanism 2250 includes a latch actuator 2252 positioned between end wall 206 and end cap 212. Latch actuator 52 is loosely retained by ribs 2254 and a skirt 2270 on a rear side 2256 of end cap 212. Latch actuator 2252 includes one or more guide slots 2258 that receive corresponding guide posts 2260 on rear side 2256 of end cap 212. A rotatable release dial 2262 is mounted to a front side 2264 of end cap 212. Release dial 2262 includes a handle 2266 that a user may engage to rotate dial 2262. A gear 2268 is rotatably coupled to release dial 2262 on rear side 2256 of end cap 212. Latch actuator 2252 includes a vertically positioned rack gear 2272 that is engaged with gear 2268 on the side of gear 2268 near the side of body 203 having positioning wing 228 (proximate to loading rail 418 and latch 430 when toner cartridge 200 is installed in tray 400).

An actuation foot 2274 extends downward from a bottom portion of latch actuator 2252. Actuation foot 2274 includes a downward facing contact surface 2276 that extends rearward toward end wall 207. Actuation foot 2274 is positioned to engage arm 436 of latch 430 from above in order to move latch 430 from the latched position to the unlatched position to release toner cartridge 200 from tray 400 as discussed above. A gap 2278 is formed between ribs 2254 and skirt 2270 that permits actuation foot 2274 to extend beyond ribs 2254 in order to contact arm 436.

In the example embodiment illustrated, latch actuator 2252 is translatable up and down with the rotational movement of dial 2262 and gear 2268. Latch actuator 2252 is biased upward such as, for example, by an extension spring 2280 (or a compression spring) on latch actuator 2252 or a torsion spring on gear 2268. When a user turns dial 2262 using handle 2266, dial 2262 and gear 2268 rotate (clockwise as viewed in FIG. 26) and the engagement between gear 2268 and rack gear 2272 of latch actuator 2252 causes latch actuator 2252 to translate downward with respect to end cap 212 and body 203. Actuation foot 2274 lowers with latch actuator 2252 in order to engage arm 436 of latch 430 to move latch 430 from the latched position to the unlatched position as discussed above. When a user releases handle 2266 of dial 2262, the bias returns latch actuator 2252 including actuation foot 2274 upward and the engagement between rack gear 2272 and gear 2268 causes dial 2262 and gear 2268 to pivot back (counterclockwise as viewed in FIG. 34). In another embodiment, latch actuator 2252 includes a circular gear that is rotatable with the rotational movement of dial 2262 and gear 2268. In this embodiment, actuation foot 2274 may extend radially from latch actuator 2252. In position to engage arm 436 of latch 430 when dial 2262 is turned and to disengage from arm 436 of latch 430 when dial 2262 is released as a result of the bias applied to latch actuator 2252.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A replaceable unit for an electrophotographic image forming device, comprising:

an elongated body extending along a lengthwise dimension between a front end and a rear end of the body, the body further including a first side, a second side, a top and a bottom, the body having a reservoir for holding toner;

a drive element on a rear face of the body at the rear end of the body unobstructed to mesh with a corresponding drive element in the image forming device on an outer axial end of the drive element of the replaceable unit when the replaceable unit is installed in the image forming device;

an electrical contact on the rear face of the body unobstructed to contact a corresponding electrical contact when the replaceable unit is installed in the image forming device;

an extension downward from the bottom of the body near the rear end of the body, the extension having a downward chute formed therein in fluid communication with the reservoir, a rear face of the extension unobstructed to receive a bias force in a forward direction toward the front end of the body along the lengthwise dimension;

an outlet port on the bottom of the extension in fluid communication with the chute for transferring toner out of the reservoir; and a latch catch on the first side of the body having a front surface that faces toward the front end of the body and that is unobstructed to contact a corresponding latch when the replaceable unit is installed in the image forming device to restrain the body from moving in the forward direction along the lengthwise dimension.

2. The replaceable unit of claim 1, further comprising a first ledge and a second ledge at the bottom of the extension, the first ledge extending away from the chute toward the first side and the second ledge extending away from the chute toward the second side, each ledge being spaced below the bottom of the body.

3. The replaceable unit of claim 2, further comprising a shutter on the bottom of the extension, the shutter being slidably movable on the first and second ledges along the lengthwise dimension between a closed position blocking the outlet port and an open position unblocking the outlet port, the shutter being biased toward the closed position, the shutter moving toward the front end of the body as the shutter moves toward the open position and toward the rear end of the body as the shutter moves toward the closed position.

4. The replaceable unit of claim 3, wherein the shutter includes a flange that wraps over one of the first ledge and the second ledge and an actuation tab extends upward from a rear end of the flange away from a top surface of said one of the first ledge and the second ledge.

5. The replaceable unit of claim 1, further comprising a positioning bump on the bottom of the body at a rearmost position on the bottom of the body, the positioning bump is unobstructed from below to permit the positioning bump to ride on top of a corresponding surface during insertion of the replaceable unit into the image forming device, the outlet port spaced farther from the rear end of the body than the positioning bump is.

6. The replaceable unit of claim 5, wherein the positioning bump is spaced toward one of the first side of the body and the second side of the body from the outlet port.

7. The replaceable unit of claim 1, further comprising a first positioning wing along the lengthwise dimension on the first side of the body and a second positioning wing along the lengthwise dimension on the second side of the body, wherein the latch catch includes a front end surface of the first positioning wing.

8. The replaceable unit of claim 7, wherein the latch catch includes a cutout in front of the front end surface of the first positioning wing positioned to receive a portion of the corresponding latch.

* * * * *